US008773419B2

(12) United States Patent
Nam et al.

(10) Patent No.: US 8,773,419 B2
(45) Date of Patent: Jul. 8, 2014

(54) LIQUID CRYSTAL DISPLAY

(75) Inventors: Yousung Nam, Kwangmyeong-si (KR); Saichang Yun, Daegu (KR); Juneho Park, Gumi-si (KR); Changdeok Lee, Cheongju-si (KR); Seungho Heo, Paju-si (KR); Daeseok Oh, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 177 days.

(21) Appl. No.: 12/958,588

(22) Filed: Dec. 2, 2010

(65) Prior Publication Data

US 2011/0134103 A1 Jun. 9, 2011

(30) Foreign Application Priority Data

Dec. 3, 2009 (KR) ..... 10-2009-0119398

(51) Int. Cl.
*G09G 5/00* (2006.01)
*G09G 3/36* (2006.01)

(52) U.S. Cl.
CPC ..... *G09G 3/3648* (2013.01); *G09G 3/3607* (2013.01); *G09G 3/3614* (2013.01); *G09G 2300/0426* (2013.01)
USPC ..... 345/212; 345/76; 345/204; 345/690

(58) Field of Classification Search
CPC ..... G09G 2300/0426; G09G 3/3607; G09G 3/3614; G09G 3/3648
USPC ..... 345/79, 30, 55, 76, 96, 204, 690
See application file for complete search history.

(56) References Cited

U.S. PATENT DOCUMENTS

| | | | | |
|---|---|---|---|---|
| 5,892,493 | A * | 4/1999 | Enami et al. | 345/94 |
| 7,679,596 | B2 * | 3/2010 | Kim et al. | 345/98 |
| 7,796,106 | B2 * | 9/2010 | Ha | 345/88 |
| 7,808,494 | B2 * | 10/2010 | Lee et al. | 345/206 |
| 7,969,397 | B2 * | 6/2011 | Cho et al. | 345/87 |
| 8,022,917 | B2 * | 9/2011 | Lin et al. | 345/98 |
| 8,179,487 | B2 * | 5/2012 | Chou et al. | 349/38 |
| 2005/0231455 | A1 | 10/2005 | Moon | |
| 2005/0243044 | A1 | 11/2005 | Kang et al. | |
| 2006/0034125 | A1 * | 2/2006 | Kim et al. | 365/185.22 |
| 2006/0081850 | A1 | 4/2006 | Lee et al. | |
| 2006/0120160 | A1 * | 6/2006 | Park et al. | 365/185.22 |

(Continued)

FOREIGN PATENT DOCUMENTS

| | | | |
|---|---|---|---|
| JP | 2005-309438 | A | 11/2005 |
| JP | 2006-48051 | A | 2/2006 |

(Continued)

*Primary Examiner* — Quan-Zhen Wang
*Assistant Examiner* — Chun-Nan Lin
(74) *Attorney, Agent, or Firm* — Birch, Stewart, Kolasch & Birch, LLP

(57) ABSTRACT

A liquid crystal display includes according to an embodiment a display panel provided with a plurality of data lines, a plurality of gate lines intersecting the data lines, liquid crystal cells arranged in a matrix, and TFTs disposed at the intersections of the data lines and the gate lines; source drive ICs configured to supply data voltages to the data lines, wherein polarities of data voltages are reversed by a column inversion scheme; and a gate driver configured to sequentially supply gate pulses for the gate lines, wherein polarities of the data voltages charged in the liquid crystal cells in the display panel are reversed in dot unit.

20 Claims, 16 Drawing Sheets

(56) References Cited

U.S. PATENT DOCUMENTS

| | | | | |
|---|---|---|---|---|
| 2006/0262069 | A1* | 11/2006 | Do et al. | 345/98 |
| 2007/0097072 | A1* | 5/2007 | Kim et al. | 345/103 |
| 2010/0250323 | A1 | 9/2010 | Noronha et al. | |
| 2010/0265238 | A1* | 10/2010 | Lee et al. | 345/211 |
| 2011/0134103 | A1* | 6/2011 | Nam et al. | 345/212 |

FOREIGN PATENT DOCUMENTS

| | | | |
|---|---|---|---|
| JP | 2006-79104 | A | 3/2006 |
| JP | 2006-106745 | A | 4/2006 |
| JP | 2007-128092 | A | 5/2007 |
| JP | 2010-250323 | A | 11/2010 |

* cited by examiner

LIQUID CRYSTAL DISPLAY

This application claims the benefit of Korea Patent Application No. 10-2009-00119398 filed on Dec. 3, 2009, the entire contents of which is incorporated herein by reference for all purposes as if fully set forth herein.

BACKGROUND

1. Field

This document relates to a liquid crystal display which drives a liquid crystal display panel in a dot inversion by using a source drive integrated circuit outputting data voltages of which polarities are reversed by a column inversion scheme.

2. Related Art

An active matrix type liquid crystal display ("LCD") displays moving pictures by the use of thin film transistors ("TFTs") as switching elements. The LCD can be made small-sized compared with a cathode ray tube (CRT) and is thus applied to portable information devices, office devices, computers, or the like, and further to television sets, as a substitute for the CRT.

The LCD includes an LC display panel, a backlight unit which provides light to the LC display panel, source drive integrated circuits (ICs) which supply data voltage for data lines in the LC display panel, gate drive ICs which supply gate pulses (or scan pulses) for gate lines (or scan lines) in the LC display panel, a control circuit which controls the above-described ICs, and a light source driving circuit which drives light sources of the backlight unit.

With the rapid development of the process techniques and the driving techniques for the LCD, a manufacturing cost of the LCD has been lowered and its image quality has been much improved. The power consumption, the image quality, and the manufacturing cost of the LCD are required to be further improved suitable for the demand for low power consumption and a low cost in an information terminal device.

SUMMARY

Embodiments of the present invention provide a liquid crystal display (LCD) comprising an LC display panel provided with a plurality of data lines, a plurality of gate lines intersecting the data lines, LC cells arranged in a matrix, and TFTs disposed at the intersections of the data lines and the gate lines; source drive ICs configured to supply data voltages to the data lines, wherein polarities of data voltages are reversed by a column inversion scheme; and a gate driving circuit configured to sequentially supply gate pulses for the gate lines.

Here, polarities of the data voltages charged in the LC cells in the LC display panel are reversed in dot unit.

In addition, at least a part of the LC display panel includes two LC cells disposed between data lines adjacent to each other in a (m+1)-th (where m is an odd number) horizontal display line so as to be spaced apart from two LC cells disposed between data lines adjacent to each other in an m-th horizontal display line.

The two LC cells in the m-th horizontal display line and the two LC cells in the (m+1)-th horizontal display line sequentially charge therein data voltages with the same polarity supplied from the same data line.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
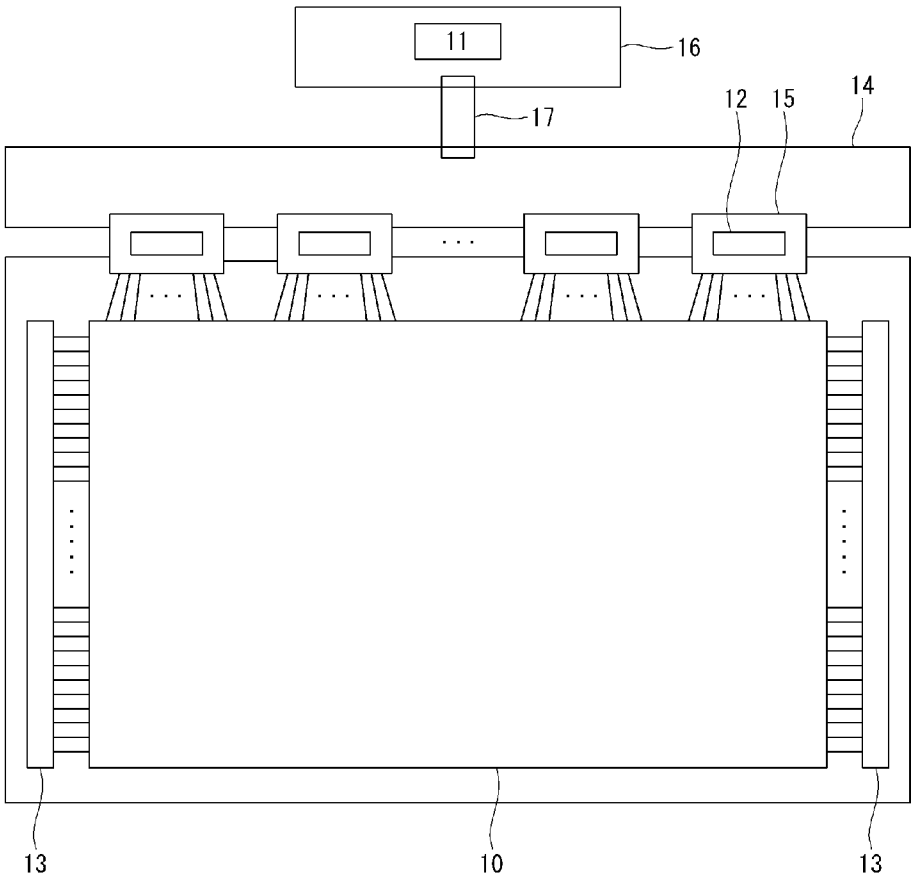
FIG. 1 is a block diagram illustrating an LCD according to an embodiment of this document.

With reference to the accompanying drawings, exemplary embodiments of this document will be described by exemplifying an LCD. Like reference numerals designate like elements throughout the specification. In the following explanations, when a detailed description of well-known functions or configurations related to this document is determined to unnecessarily cloud a gist of this document, the detailed description thereof will be omitted.

Names of the respective elements used in the following explanations are selected for convenience of writing the specification and may be thus different from those in actual products.

Referring to FIG. 1, an LCD according to an embodiment of this document an LC display panel provided with a pixel array 10, source drive ICs 12, and a timing controller 11. A backlight unit, which uniformly provides light to the LC display panel, may be placed at a lower part of the LC display panel.

The LC display panel comprises an upper glass substrate and a lower glass substrate opposite to each other with an LC layer therebetween. The LC display panel is provided with the pixel array 10. The pixel array 10 includes LC cells arranged in a matrix by the intersection structure of data lines and gate lines. The lower glass substrate of the pixel array 10 is provided with the data lines, the gate lines, TFTs, pixel electrodes of the LC cells connected to the TFTs, storage capacitors Cst connected to the pixel electrodes of the LC cells and so on.

Each of the LC cells in the pixel array 10 is driven by a voltage difference between a voltage charged in the pixel electrode via the TFT and a common voltage applied to a common electrode, and this voltage difference controls transmittance of light passing the LC cell to display images corresponding to video data. A structure of the pixel array 10 will be described in detail with reference to following figures.

The upper glass substrate of the LC display panel is provided with black matrices, color filters and the common electrodes. The common electrodes are disposed on the upper glass substrate in a vertical field driving type such as a TN (twisted nematic) mode and a VA (vertically aligned) mode, and are disposed on the lower glass substrate along with the pixel electrodes in a horizontal field driving type such as an IPS (in-plane switching) mode and an FFS (fringe field switching) mode.

Polarizers are respectively attached to the outer surfaces of the lower and upper glass substrates of the LC display panel, and alignment layers are formed on the inner surfaces having contact to the LC layer to set pretilt angles of the LC layer.

The LCD may be implemented by not only the TN mode, the VA mode, the IPS mode, and the FFS mode, but also any other LC mode. The LCD may be implemented by any other type LCD such as a transmissive LCD, a transflective LCD, a reflective LCD, or the like. The transmissive LCD and the reflective LCD require the backlight unit. The backlight unit may be implemented by a direct type backlight unit or an edge type backlight unit.

The source drive ICs 12 are mounted on tape carrier packages (TCPs) 15, joined to the lower glass substrate of the LC display panel and connected to a source printed circuit board (PCB) 14 by a TAB (tap automated bonding) process. The source drive ICs 12 may be attached to the lower glass substrate of the LC display panel. Each of data output channels of the source drive ICs 12 is connected to each data line in the pixel array 10. The total number of the output channels of the source drive ICs 12 is about a half the total number of the data lines.

Figure 4:
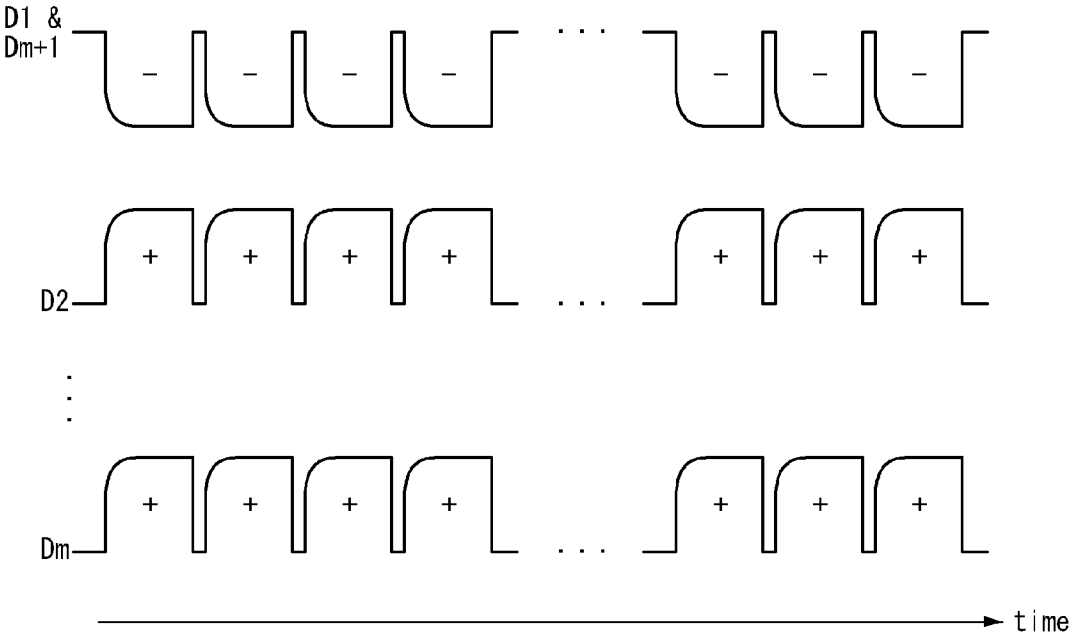
FIG. 4 is a waveform diagram illustrating data voltages supplied for the data lines in the LCD as shown in FIG. 3.
Figure 6:
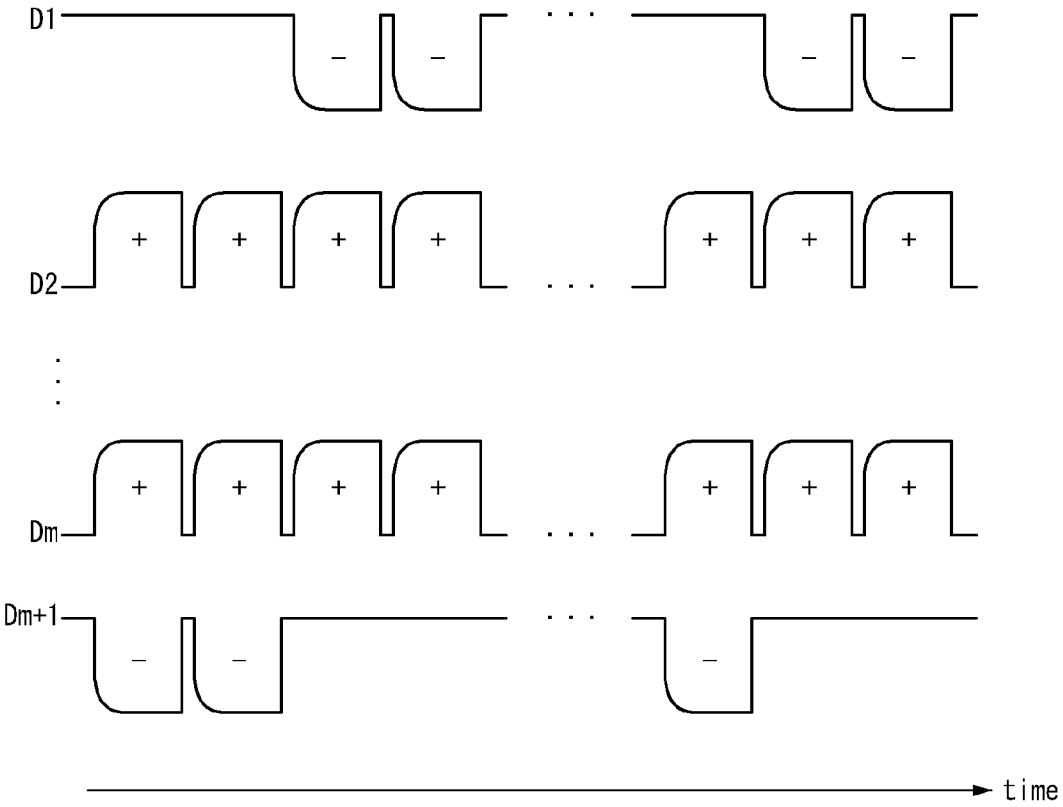
FIG. 6 is a waveform diagram illustrating data voltages supplied for the data lines in the LCD shown in FIG. 5.

Each of the source drive ICs 12 receives digital video data from the timing controller 11. The source drive ICs 12 convert the digital video data into positive/negative data voltage in response to source timing control signals from the timing controller 11, and supply the converted data voltages for the data lines in the pixel array 10 via the output channels. The source drive ICs 12 supply the data voltages with polarities opposite to each other for adjacent data lines under the control of the timing controller 11, and the polarities of the data voltages supplied for the respective data lines are maintained unchanged during one frame period. Thus, the source drive ICs 12 output the data voltages of which the polarities are reversed by a column inversion scheme as shown in FIGS. 4 and 6.

The gate drivers 13 sequentially supply the gate pulses (or scan pulses) for the gate lines in the pixel array in response to gate timing control signals from the timing controller 11. The gate drivers 13 may be mounted on TCPs and joined to the lower glass substrate of the LC display panel by the TAB process, or may be directly formed on the lower glass substrate along with the pixel array 10 by a GIP (gate in panel) process. The gate drivers 13 may be disposed at both sides of the pixel array 10 as shown in FIG. 2, or may be disposed at one side of the pixel array 10.

The timing controller 11 transmits the digital video data from an external system board to the source drive ICs 12. The timing controller 11 generates the source timing control signals for controlling operation timings of the source drive ICs 12 and the gate timing control signals for controlling operation timings of the gate drivers 13. The timing controller 11 is mounted on a control PCB 16. The control PCB 16 and the source PCB 14 are connected to each other via a flexible printed circuit board 17 such as an FFC (flexible flat cable) or an FPC (flexible printed circuit).

Figure 2:
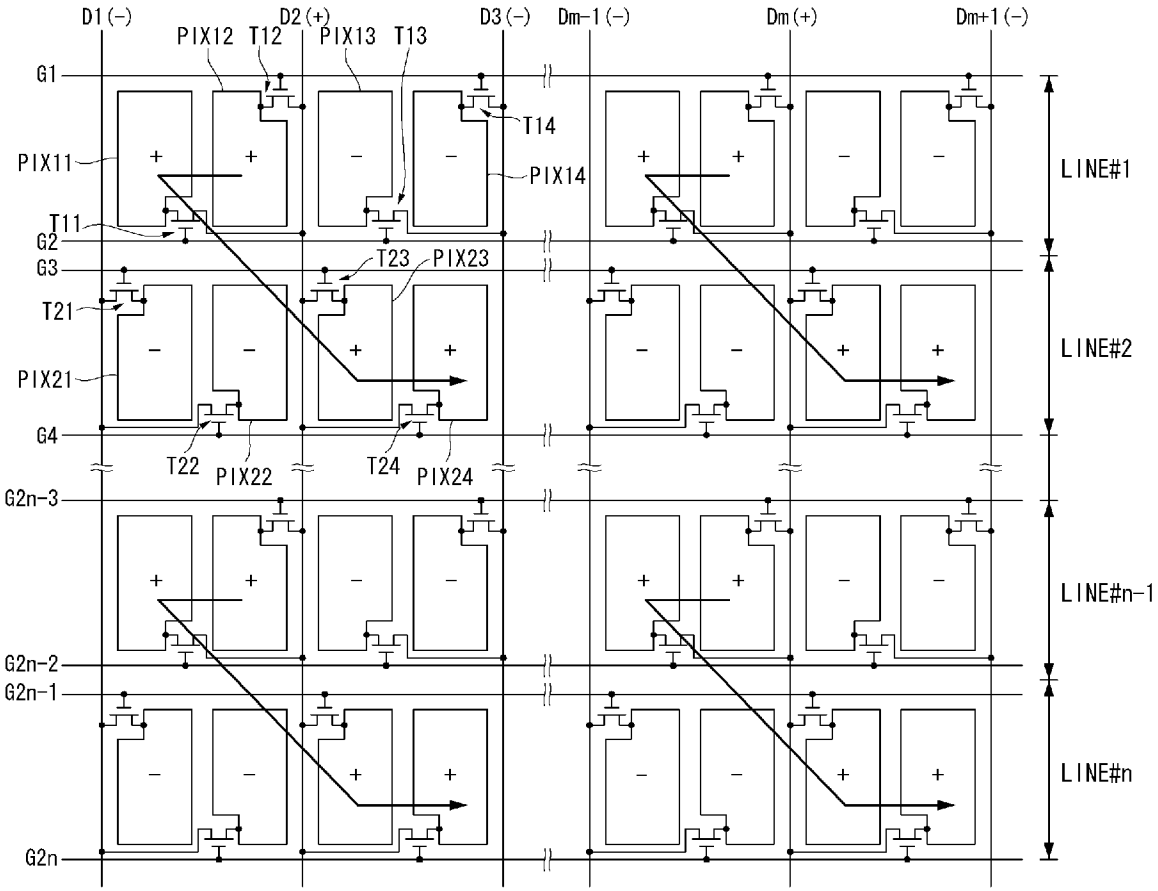
FIG. 2 is a detailed circuit diagram illustrating a first embodiment of the pixel array shown in FIG. 1.

FIG. 2 is a circuit diagram illustrating a first embodiment of the pixel array 10.

In FIG. 2, the pixel array 10 is provided with (m+1) data lines D1 to Dm+1, the gate lines G1 to G2*n* intersecting the data lines D1 to Dm+1, and the TFTs T11 to T14 and T21 to T24 which switch current paths formed between the pixel electrodes PIX11 to PIX14 and PIX21 to PIX24 in the LC cells and the data lines D1 to Dm+1 in response to the gate pulses. The number of the LC cells arranged in a single horizontal display line in this pixel array is 2m.

For the data voltages charged in the LC cells due to the pixel array structure in FIG. 2, their polarities are reversed in a unit of horizontal 2-dot and vertical 1-dot inversion. In FIG. 2, the arrow indicates an order of the data voltages being charged in the LC cells.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to Gln.

During an N-th (where N is an odd number) frame period, the source drive ICs 12 supply only negative data voltages for the odd-numbered data lines D1, D3, . . . , Dm−1 and Dm+1, and supply only positive data voltages for the even-numbered data lines D2, D4, . . . , and Dm. During a (N+1)-th frame period, the source drive ICs 12 supply only the positive data voltages for the odd-numbered data lines D1, D3, . . . , Dm−1 and Dm+1, and supply only the negative data voltages for the even-numbered data lines D2, D4, . . . , and Dm.

In embodiments described below, a character i for the data lines has a value equal to or less than m, and may have different values in each embodiment. The a character i is natural number. For example, in the embodiments shown in FIGS. 2, 7, 8, 10, 11, 12, 15 and 16, the character i=3k−2 (where k is a natural number), and, in the embodiments shown in FIGS. 9, 13 and 14, the character i=4k−3. In the respective odd-numbered horizontal display lines LINE#1, LINE#3, . . . , and LINE#n−1, first and second LC cells in the odd-numbered horizontal display lines disposed between an i-th data line and a (i+1)-th data line charge therein the positive data voltages supplied from the (i+1)-th data line during the N-th frame period, and thereafter charge therein the negative data voltages supplied from the (i+1)-th data line during the (N+1)-th frame period. In FIG. 2, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines. In addition, in the respective even-numbered horizontal display lines LINE#2, LINE#4, . . . , and LINE#n, third and fourth LC cells in the even-numbered horizontal display lines disposed between the (i+1)-th data line and a (i+2) data line charge therein the positive data voltages supplied from the (i+1)-th data line during the N-th frame period, and thereafter charge therein the negative data voltages supplied from the (i+1)-th data line during the (N+1)-th frame period. In FIG. 2, the reference numeral "PIX23"

denotes the third pixel electrodes formed in the third LC cells in the even-numbered horizontal display lines, and the reference numeral "PIX24" denotes the fourth pixel electrodes formed in the fourth LC cells in the even-numbered horizontal display lines. Therefore, the first and second LC cells in the odd-numbered horizontal display lines and the third and fourth LC cells in the even-numbered horizontal display lines charge therein the voltages with the same polarity supplied from the (i+1)-th data line.

In the respective odd-numbered horizontal display lines LINE#1, LINE#3, . . . , and LINE#n−1, third and fourth LC cells in the odd-numbered horizontal display lines disposed between the (i+1)-th data line and the (i+2)-th data line charge therein the negative data voltages supplied from the (i+2)-th data line during the N-th frame period, and thereafter charge therein the positive data voltages supplied from the (i+2)-th data line during the (N+1)-th frame period. In FIG. 2, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines. In addition, in the respective even-numbered horizontal display lines LINE#2, LINE#4, . . . , and LINE#n, fifth and sixth LC cells in the even-numbered horizontal display lines disposed between the (i+2)-th data line and a (i+3)-th data line charge therein the negative data voltages supplied from the (i+2)-th data line during the N-th frame period, and thereafter charge therein the positive data voltages supplied from the (i+2)-th data line during the (N+1)-th frame period. In FIG. 2, the fifth and sixth LC cells in the even-numbered horizontal display lines are not shown, and their connection structures are substantially the same as those of the first and second LC cells. Therefore, the third and fourth LC cells in the odd-numbered horizontal display lines and the fifth and sixth LC cells in the even-numbered horizontal display lines charge therein the voltages with the same polarity supplied from the (i+2)-th data line. Meanwhile, the first and second LC cells in the even-numbered horizontal display lines charge therein the data voltages with the same polarity supplied from the i-th data line.

In the pixel array 10 shown in FIG. 2, connection relations among the TFTs, the pixel electrodes, and the data lines will be described by exemplifying the first to fourth LC cells in the first horizontal display line LINE#1, and the first to fourth LC cells in the second horizontal display line LINE#2.

In the first horizontal display line LINE#1, the first and second LC cells disposed between the first data line D1 and the second data line D2 charge therein data voltages sequentially supplied from the second data line D2. The first TFT T11 in the first horizontal display line transmits the data voltage from the second data line D2 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the second data line D2, and a source terminal thereof is connected to the first pixel electrode PIX11. The second TFT T12 in the first horizontal display line transmits the data voltage from the second data line D2 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the second data line D2, and a source terminal thereof is connected to the second pixel electrode PIX12.

In the first horizontal display line LINE#1, the third and fourth LC cells disposed between the second data line D2 and the third data line D3 charge therein data voltages sequentially supplied from the third data line D3. The third TFT T13 in the first horizontal display line transmits the data voltage from the third data line D3 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the third data line D3, and a source terminal thereof is connected to the third pixel electrode PIX13. The fourth TFT T14 in the first horizontal display line transmits the data voltage from the third data line D3 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the third data line D3, and a source terminal thereof is connected to the fourth pixel electrode PIX14.

In the second horizontal display line LINE#2, the first and second LC cells disposed between the first data line D1 and the second data line D2 charge therein data voltages sequentially supplied from the first data line D1. The first TFT T21 in the second horizontal display line transmits the data voltage from the first data line D1 to the first pixel electrode PIX21 in response to the third gate pulse from the third gate line G3. The first pixel electrode PIX21 charges the data voltage therein during about ½ horizontal period. A gate terminal of the first TFT T21 is connected to the third gate line G3. A drain terminal of the first TFT T21 is connected to the first data line D1, and a source terminal thereof is connected to the first pixel electrode PIX21. The second TFT T22 in the second horizontal display line transmits the data voltage from the first data line D1 to the second pixel electrode PIX22 in response to the fourth gate pulse from the fourth gate line G4. The second pixel electrode PIX22 charges the data voltage therein during about ½ horizontal period. A gate terminal of the second TFT T22 is connected to the fourth gate line G4. A drain terminal of the second TFT T22 is connected to the first data line D1, and a source terminal thereof is connected to the second pixel electrode PIX22.

In the second horizontal display line LINE#2, the third and fourth LC cells disposed between the second data line D2 and the third data line D3 charge therein the data voltages sequentially supplied from the second data line D2. The third and fourth LC cells in the second horizontal display line LINE#2 are spaced apart from the first and the second LC cells in the first horizontal display line LINE#1 in the diagonal direction, and share the second data line D2 with the first and the second LC cells in the first horizontal display line LINE#1. Therefore, the first and second in the first horizontal display line LINE#1 and the third and fourth LC cells sequentially charge therein the data voltages with the same polarity which are consecutively supplied via the second data line D2.

The third TFT T23 in the second horizontal display line transmits the data voltage from the second data line D2 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the second data line D2, and a source terminal thereof is connected to the third pixel electrode PIX23. The fourth TFT T24 in the second horizontal display line transmits the data voltage from the second data line D2 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the second data line D2, and a source terminal thereof is connected to the fourth pixel electrode PIX24.

In the LCD according to the embodiment of this document, the polarity of the data voltages charged in the LC cells connected to the same data line is the same, thereby it is possible to reduce power consumption in the source drive ICs and also make an amount of data charged in each LC cell uniform. Thus, according to this document, it is possible to prevent degradation in image quality such as brightness unevenness, color distortion, or the like resulting from the unevenness of the amount of data charged due to the inversion method in the related art. In addition, according to this document, it is possible to reduce the number of the data lines and the channels of the source drive ICs by the use of the TFT connection relation where the LC cells adjacent to each other in the horizontal direction share one data line with each other, and furthermore, to reduce the manufacturing cost of the LCD.

The pixel array 10 is not limited to that shown in FIG. 2. For example, the pixel array 10 may be modified as shown in FIGS. 7 to 16. In the embodiments in FIGS. 7 to 16 as well, the number of data lines is reduced by half, and the data voltages from the source drive ICs 12 are output by the column inversion scheme, and the LC cells in the pixel array 10 are driven by the dot inversion scheme.

Figure 3:
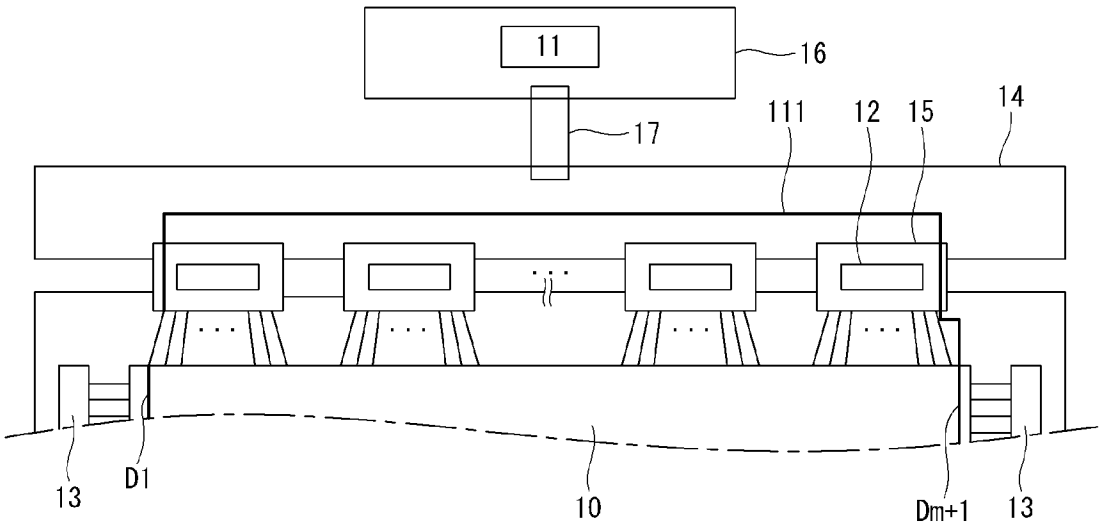
FIG. 3 is a diagram illustrating an example where the first data line is connected to the (m+1)-th data line.

The (m+1)-th data line Dm+1 disposed at the rightmost of the pixel array 10 may be connected to the first data line D1 disposed at the leftmost of the pixel array 10 like in FIG. 3. FIG. 4 is a waveform diagram illustrating the data voltages provided to the data lines D1 to Dm+1 in the LCD shown in FIG. 3.

Referring to FIGS. 3 and 4, the LCD further comprises a connection line 111 extending via the TCPs 15 and the source PCB 14.

The one end of the connection line 111 is connected to the first data line D1, and the other end of the connection line 111 is connected to the (m+1)-th data line Dm+1. Among the source drive ICs 12, the output channel of the first source drive IC 12 disposed at the uppermost left of the pixel array 10 provide the data voltages to the first data line D1 and the (m+1)-th data line Dm+1.

Figure 5:
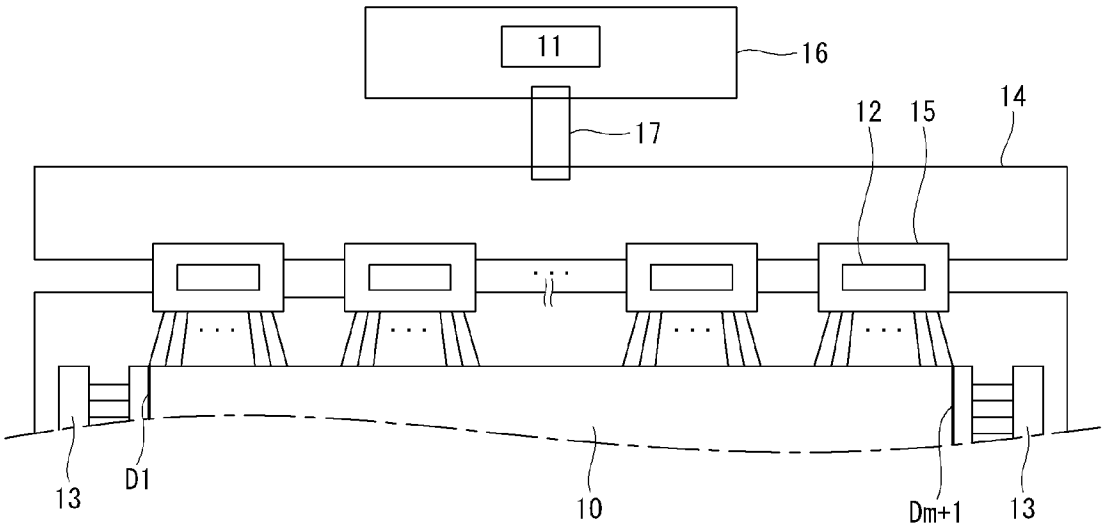
FIG. 5 is a diagram illustrating an example where the (m+1)-th data line is connected to an output channel of the source drive IC.

The (m+1)-th data Dm+1 disposed at the rightmost of the pixel array 10 may be connected to the output channel of the source drive IC 12 in the state of not being connected to the first data line D1 as shown in FIG. 5. FIG. 6 is a waveform diagram illustrating waveforms of the data voltages provided to the data lines in the LCD shown in FIG. 5.

Referring to FIGS. 5 and 6, the source drive IC 12, which is disposed at the uppermost right of the LC display panel, further comprises an output channel connected to the (m+1)-th data line Dm+1. Therefore, the (m+1)-th data line Dm+1 is directly supplied with data voltages from the last source drive IC 12 disposed at the uppermost right of the pixel array 10, among the source drive ICs 12.

Figure 7:
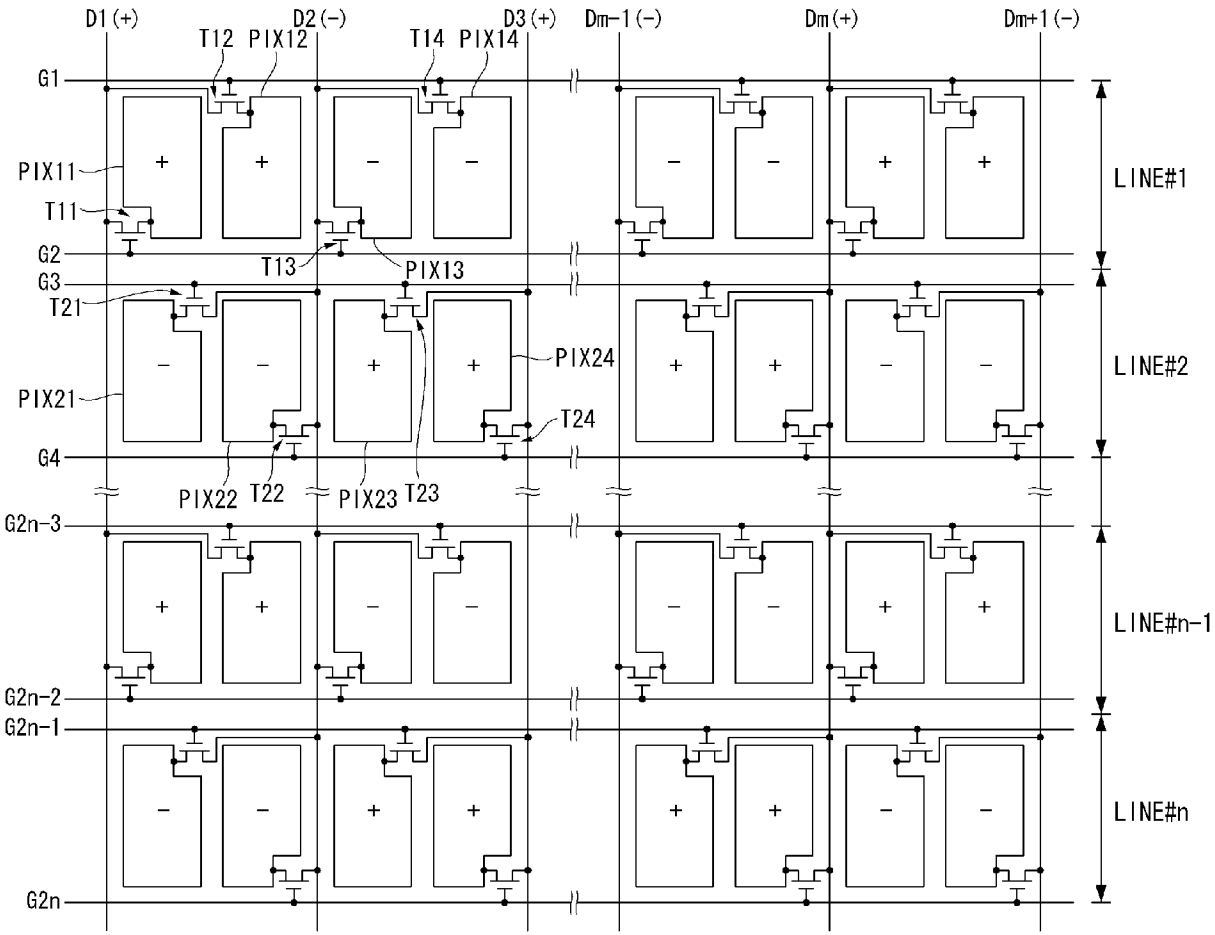
FIG. 7 is a detailed circuit diagram illustrating a second embodiment of the pixel array shown in FIG. 1.

FIG. 7 is a circuit diagram illustrating a second embodiment of the pixel array 10.

In FIG. 7, the pixel array 10 is provided with data lines D1 to Dm+1, gate lines G1 to G2*n* intersecting the data lines D1 to Dm+1, and TFTs T11 to T14 and T21 to T24 which switch current paths formed between the pixel electrodes PIX11 to PIX14 and PIX21 to PIX24 in LC cells and the data lines D1 to Dm+1 in response to gate pulses. For the data voltages charged in the LC cells due to the pixel array structure in FIG. 7, their polarities are reversed in a unit of horizontal 2-dot and vertical 1-dot (1×2 dots).

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines disposed between an i-th data line and a (i+1)-th data line charge therein the positive data voltages supplied from the (i+1)-th data line during the N-th frame period, and thereafter charge therein the negative data voltages supplied from the i-th data line during the (N+1)-th frame period. In FIG. 7, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines disposed between the (i+1)-th data line and a (i+2)-th data line charge therein the negative data voltages supplied from the (i+1)-th data line during the N-th frame period, and thereafter charge therein the positive data voltages supplied from the (i+1)-th data line during the (N+1)-th frame period. In FIG. 7, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines. In addition, in the respective even-numbered horizontal display lines LINE#2, LINE#4, . . . , and LINE#n, first and second LC cells in the even-numbered horizontal display lines disposed between the i-th data line and the (i+1) data line charge therein the negative data voltages supplied from the (i+1)-th data line during the N-th frame period, and thereafter charge therein the positive data voltages supplied from the (i+1)-th data line during the (N+1)-th frame period. In FIG. 7, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines. Therefore, the third and fourth LC cells in the odd-numbered horizontal display lines and the first and second LC cells in the even-numbered horizontal display lines charge therein the voltages with the same polarity supplied from the (i+1)-th data line.

In the respective even-numbered horizontal display lines LINE#2, LINE#4, . . . , and LINE#n, third and fourth LC cells in the even-numbered horizontal display lines disposed between the (i+1)-th data line and a (i+2) data line charge therein the positive data voltages supplied from the (i+2)-th data line during the N-th frame period, and thereafter charge therein the negative data voltages supplied from the (i+2)-th data line during the (N+1)-th frame period. In FIG. 7, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

In the pixel array 10 shown in FIG. 7, connection relations among the TFTs, the pixel electrodes, and the data lines will be described by exemplifying the first to fourth LC cells in the first horizontal display line LINE#1, and the first to fourth LC cells in the second horizontal display line LINE#2.

In the first horizontal display line LINE#1, the first and second LC cells disposed between the first data line D1 and the second data line D2 charge therein data voltages sequentially supplied from the first data line D1. The first TFT T11 in the first horizontal display line transmits the data voltage from the first data line D1 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the first data line D1, and a source terminal thereof is connected to the first pixel electrode PIX11. The second TFT T12 in the first horizontal display line transmits the data voltage from the first data line D1 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the first data line D1, and a source terminal thereof is connected to the second pixel electrode PIX12.

In the first horizontal display line LINE#1, the third and fourth LC cells disposed between the second data line D2 and the third data line D3 charge therein data voltages sequentially supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the second data line D2 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the second data line D2, and a source terminal thereof is connected to the fourth pixel electrode PIX14.

In the second horizontal display line LINE#2, the first and second LC cells disposed between the first data line D1 and the second data line D2 charge therein data voltages sequentially supplied from the second data line D2. The first TFT T21 in the second horizontal display line transmits the data voltage from the second data line D2 to the first pixel electrode PIX21 in response to the third gate pulse from the third gate line G3. The first pixel electrode PIX21 charges the data voltage therein during about ½ horizontal period. A gate terminal of the first TFT T21 is connected to the third gate line G3. A drain terminal of the first TFT T21 is connected to the second data line D2, and a source terminal thereof is connected to the first pixel electrode PIX21. The second TFT T22 in the second horizontal display line transmits the data voltage from the second data line D2 to the second pixel electrode PIX22 in response to the fourth gate pulse from the fourth gate line G4. The second pixel electrode PIX22 charges the data voltage therein during about ½ horizontal period. A gate terminal of the second TFT T22 is connected to the fourth gate line G4. A drain terminal of the second TFT T22 is connected to the second data line D2, and a source terminal thereof is connected to the second pixel electrode PIX22.

In the second horizontal display line LINE#2, the third and fourth LC cells disposed between the second data line D2 and the third data line D3 charge therein the data voltages sequentially supplied from the third data line D3. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the third data line D3 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the third data line D3, and a source terminal thereof is connected to the fourth pixel electrode PIX24.

Figure 8:
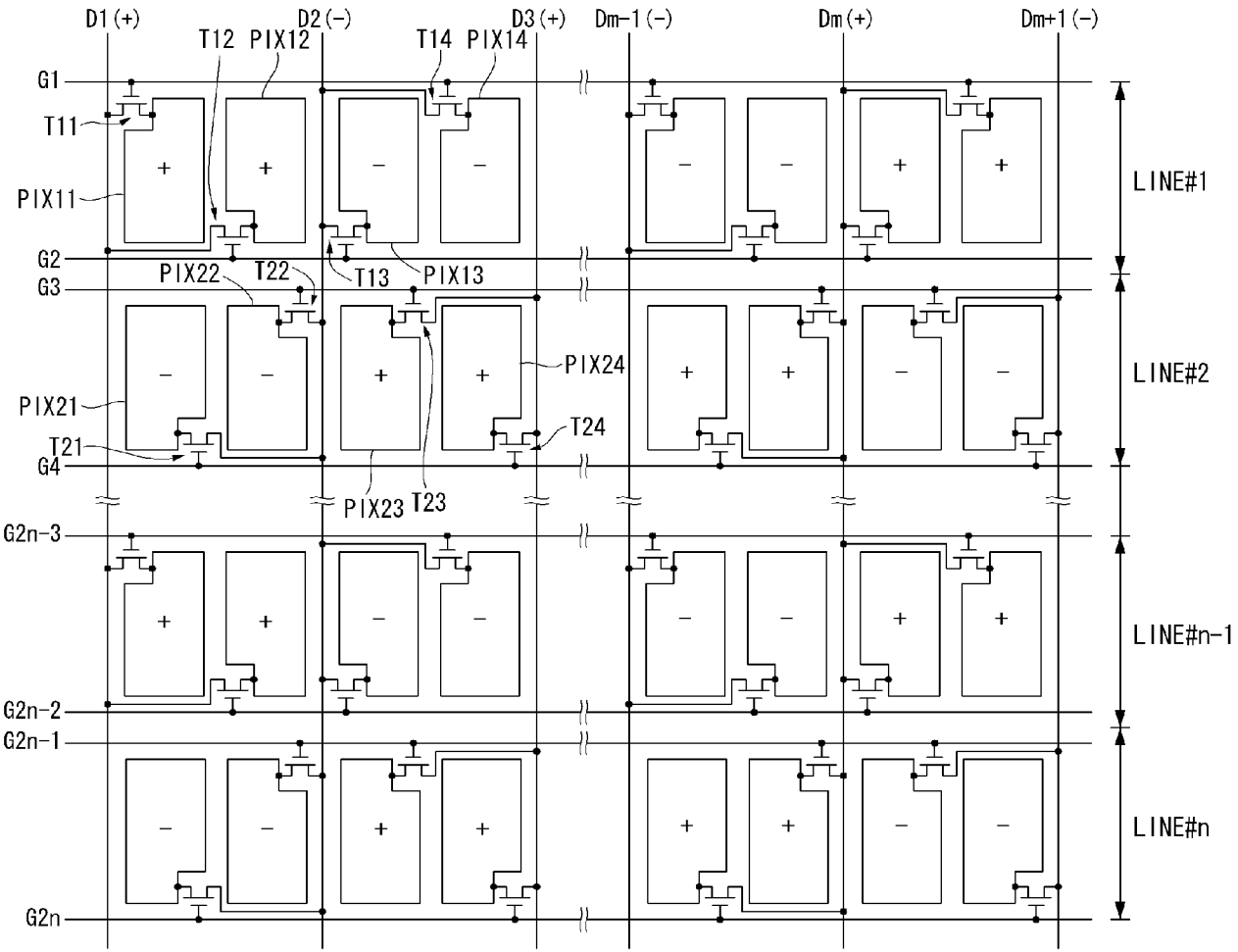
FIG. 8 is a detailed circuit diagram illustrating a third embodiment of the pixel array shown in FIG. 1.

FIG. 8 is a circuit diagram illustrating a third embodiment of the pixel array 10.

Referring to FIG. 8, the pixel array 10 is provided with data lines D1 to Dm+1, gate lines G1 to G2*n* intersecting the data lines D1 to Dm+1, and TFTs T11 to T14 and T21 to T24 which switch current paths formed between the pixel electrodes PIX11 to PIX14 and PIX21 to PIX24 in LC cells and the data lines D1 to Dm+1 in response to gate pulses. For the data voltages charged in the LC cells due to the pixel array structure in FIG. 8, their polarities are reversed in a unit of horizontal 2-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm.

During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines disposed between an i-th data line and a (i+1)-th data line charge therein the positive data voltages supplied from the (i+1)-th data line during the N-th frame period, and thereafter charge therein the negative data voltages supplied from the i-th data line during the (N+1)-th frame period. In FIG. 8, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines disposed between the (i+1)-th data line and a (i+2)-th data line charge therein the negative data voltages supplied from the (i+1)-th data line during the N-th frame period, and thereafter charge therein the positive data voltages supplied from the (i+1)-th data line during the (N+1)-th frame period. In FIG. 8, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines. In addition, in the respective even-numbered horizontal display lines LINE#2, LINE#4, . . . , and LINE#n, first and second LC cells in the even-numbered horizontal display lines disposed between the i-th data line and the (i+1) data line charge therein the negative data voltages supplied from the (i+1)-th data line during the N-th frame period, and thereafter charge therein the positive data voltages supplied from the (i+1)-th data line during the (N+1)-th frame period. In FIG. 8, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines. Therefore, the third and fourth LC cells in the odd-numbered horizontal display lines and the first and second LC cells in the even-numbered horizontal display lines charge therein the voltages with the same polarity supplied from the (i+1)-th data line.

In the respective even-numbered horizontal display lines LINE#2, LINE#4, . . . , and LINE#n, third and fourth LC cells in the even-numbered horizontal display lines disposed between the (i+1)-th data line and a (i+2) data line charge therein the positive data voltages supplied from the (i+2)-th data line during the N-th frame period, and thereafter charge therein the negative data voltages supplied from the (i+2)-th data line during the (N+1)-th frame period. In FIG. 8, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

In the pixel array 10 shown in FIG. 8, connection relations among the TFTs, the pixel electrodes, and the data lines will be described by exemplifying the first to fourth LC cells in the first horizontal display line LINE#1, and the first to fourth LC cells in the second horizontal display line LINE#2.

In the first horizontal display line LINE#1, the first and second LC cells disposed between the first data line D1 and the second data line D2 charge therein data voltages sequentially supplied from the first data line D1. The first TFT T11 in the first horizontal display line transmits the data voltage from the first data line D1 to the first pixel electrode PIX11 in response to the first gate pulse from the first gate line G1. The first pixel electrode PIX11 charges the data voltage therein during about ½ horizontal period. A gate terminal of the first TFT T11 is connected to the first gate line G1. A drain terminal of the first TFT T11 is connected to the first data line D1, and a source terminal thereof is connected to the first pixel electrode PIX11. The second TFT T12 in the first horizontal display line transmits the data voltage from the first data line D1 to the second pixel electrode PIX12 in response to the second gate pulse from the second gate line G2. The second pixel electrode PIX12 charges the data voltage therein during about ½ horizontal period. A gate terminal of the second TFT T12 is connected to the second gate line G2. A drain terminal of the second TFT T12 is connected to the first data line D1, and a source terminal thereof is connected to the second pixel electrode PIX12.

In the first horizontal display line LINE#1, the third and fourth LC cells disposed between the second data line D2 and the third data line D3 charge therein data voltages sequentially supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the second data line D2 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the second data line D2, and a source terminal thereof is connected to the fourth pixel electrode PIX14.

In the second horizontal display line LINE#2, the first and second LC cells disposed between the first data line D1 and the second data line D2 charge therein data voltages sequentially supplied from the second data line D2. The first TFT T21 in the second horizontal display line transmits the data voltage from the second data line D2 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the second data line D2, and a source terminal thereof is connected to the first pixel electrode PIX21. The second TFT T22 in the second horizontal display line transmits the data voltage from the second data line D2 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the second data line D2, and a source terminal thereof is connected to the second pixel electrode PIX22.

In the second horizontal display line LINE#2, the third and fourth LC cells disposed between the second data line D2 and the third data line D3 charge therein the data voltages sequentially supplied from the third data line D3. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the third data line D3 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the third data line D3, and a source terminal thereof is connected to the fourth pixel electrode PIX24.

Figure 9:
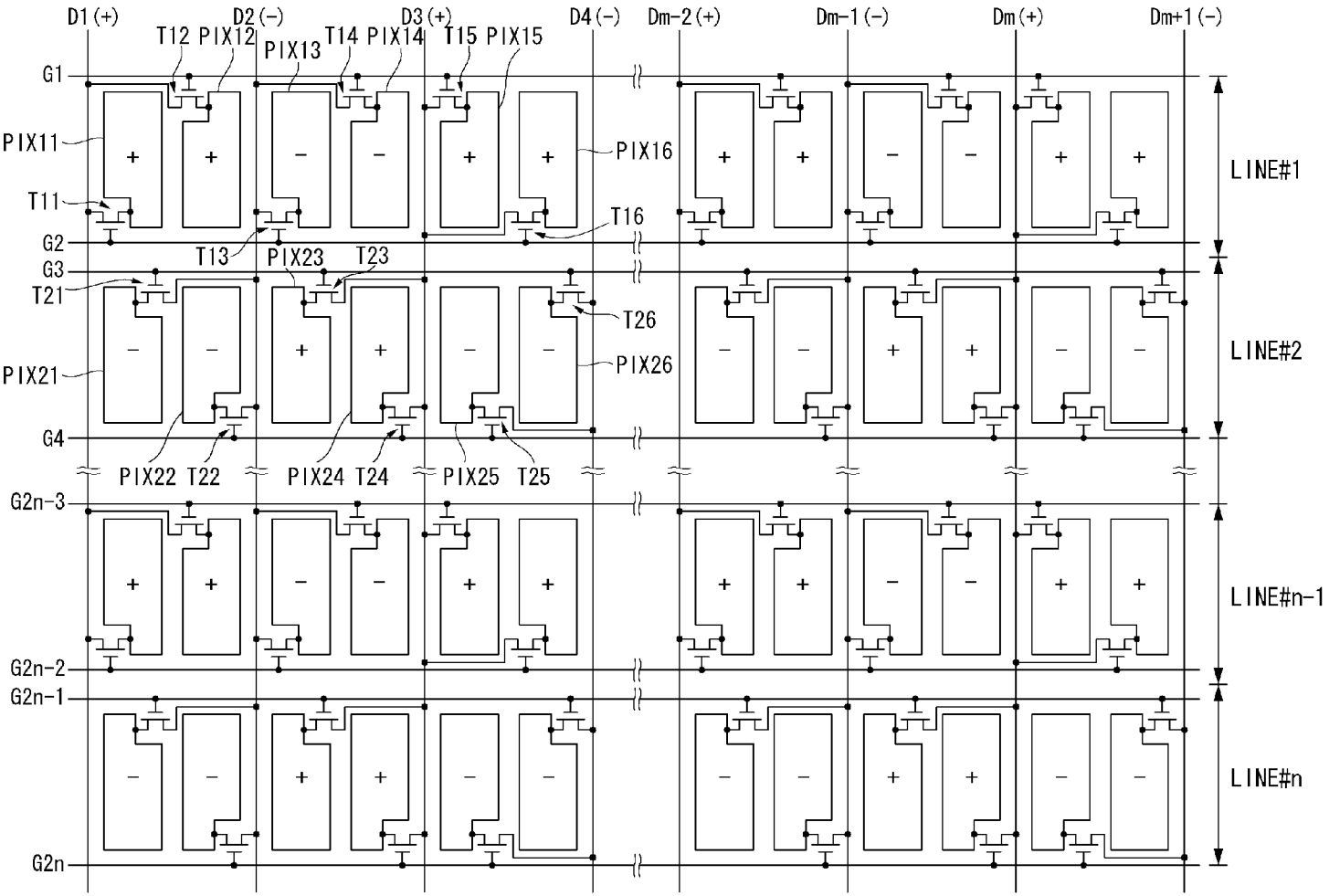
FIG. 9 is a detailed circuit diagram illustrating a fourth embodiment of the pixel array shown in FIG. 1.

FIG. 9 is a circuit diagram illustrating a fourth embodiment of the pixel array 10.

In FIG. 9, the pixel array 10 is provided with data lines D1 to Dm+1, gate lines G1 to G2*n* intersecting the data lines D1 to Dm+1, and TFTs T11 to T16 and T21 to T26 which switch current paths formed between the pixel electrodes PIX11 to PIX16 and PIX21 to PIX26 in LC cells and the data lines D1 to Dm+1 in response to gate pulses. For the data voltages charged in the LC cells due to the pixel array structure in FIG. 9, their polarities are reversed in a unit of horizontal 2-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines disposed between an i-th data line and a (i+1)-th data line charge therein the positive data voltages supplied from the i-th data line during the N-th frame period, and thereafter charge therein the negative data voltages supplied from the i-th data line during the (N+1)-th frame period. In FIG. 9, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines disposed between the (i+1)-th data line and a (i+2)-th data line charge therein the negative data voltages supplied from the (i+1)-th data line during the N-th frame period, and thereafter charge therein the positive data voltages supplied from the (i+1)-th data line during the (N+1)-th frame period. In FIG. 9, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines. In addition, in the respective even-numbered horizontal display lines LINE#2, LINE#4, . . . , and LINE#n, first and second LC cells in the even-numbered horizontal display lines disposed between the i-th data line and the (i+1) data line charge therein the negative data voltages supplied from the (i+1)-th data line during the N-th frame period, and thereafter charge therein the positive data voltages supplied from the (i+1)-th data line during the (N+1)-th frame period. In FIG. 9, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines. Therefore, the third and fourth LC cells in the odd-numbered horizontal display lines and the first and second LC cells in the even-numbered horizontal display lines charge therein the data voltages with the same polarity supplied from the (i+1)-th data line.

In the respective odd-numbered horizontal display lines LINE#1, LINE#3, . . . , and LINE#n−1, fifth and sixth LC cells in the odd-numbered horizontal display lines disposed between the (i+2)-th data line and a (i+3)-th data line charge therein the positive data voltages supplied from the (i+2)-th data line during the N-th frame period, and thereafter charge therein the negative data voltages supplied from the (i+2)-th data line during the (N+1)-th frame period. In FIG. 9, the reference numeral "PIX15" denotes the fifth pixel electrodes formed in the fifth LC cells in the odd-numbered horizontal display lines, and the reference numeral "PIX16" denotes the sixth pixel electrodes formed in the sixth LC cells in the odd-numbered horizontal display lines. In addition, in the respective even-numbered horizontal display lines LINE#2, LINE#4, . . . , and LINE#n, third and fourth LC cells in the even-numbered horizontal display lines disposed between the (i+1)-th data line and the (i+2) data line charge therein the positive data voltages supplied from the (i+2)-th data line during the N-th frame period, and thereafter charge therein the negative data voltages supplied from the (i+2)-th data line during the (N+1)-th frame period. In FIG. 9, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines. Therefore, the fifth and sixth LC cells in the odd-numbered horizontal display lines and the third and fourth LC cells in the even-numbered horizontal display lines charge therein the data voltages with the same polarity supplied from the (i+2)-th data line.

In the respective even-numbered horizontal display lines LINE#2, LINE#4, . . . , and LINE#n, fifth and sixth LC cells in the even-numbered horizontal display lines disposed between the (i+2)-th data line and the (i+3)-th data line charge therein the negative data voltages supplied from the (i+3)-th data line during the N-th frame period, and thereafter charge therein the positive data voltages supplied from the (i+3)-th data line during the (N+1)-th frame period. In FIG. 9, the reference numeral "PIX25" denotes the fifth pixel electrodes formed in the fifth LC cells in the even-numbered horizontal display lines, and the reference numeral "PIX26" denotes the sixth pixel electrodes formed in the sixth LC cells in the even-numbered horizontal display lines.

In the pixel array 10 shown in FIG. 9, connection relations among the TFTs, the pixel electrodes, and the data lines will be described by exemplifying the first to sixth LC cells in the first horizontal display line LINE#1, and the first to sixth LC cells in the second horizontal display line LINE#2.

In the first horizontal display line LINE#1, the first and second LC cells disposed between the first data line D1 and the second data line D2 charge therein data voltages sequentially supplied from the first data line D1. The first TFT T11 in the first horizontal display line transmits the data voltage from the first data line D1 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the first data line D1, and a source terminal thereof is connected to the first pixel electrode PIX11. The second TFT T12 in the first horizontal display line transmits the data voltage from the first data line D1 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the first data line D1, and a source terminal thereof is connected to the second pixel electrode PIX12.

In the first horizontal display line LINE#1, the third and fourth LC cells disposed between the second data line D2 and the third data line D3 charge therein data voltages sequentially supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the second data line D2 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the second data line D2, and a source terminal thereof is connected to the fourth pixel electrode PIX14.

In the first horizontal display line LINE#1, the fifth and sixth LC cells disposed between the third data line D3 and the fourth data line D4 charge therein data voltages sequentially supplied from the third data line D3. The fifth TFT T15 in the first horizontal display line transmits the data voltage from the third data line D3 to the fifth pixel electrode PIX15 in response to the first gate pulse from the first gate line G1. The fifth pixel electrode PIX15 charges the data voltage therein during about ½ horizontal period. A gate terminal of the fifth TFT T15 is connected to the first gate line G1. A drain terminal of the fifth TFT T15 is connected to the third data line D3, and a source terminal thereof is connected to the fifth pixel electrode PIX15. The sixth TFT T16 in the first horizontal display line transmits the data voltage from the third data line D3 to the sixth pixel electrode PIX16 in response to the second gate pulse from the second gate line G2. The sixth pixel electrode PIX16 charges the data voltage therein during about ½ horizontal period. A gate terminal of the fourth TFT T16 is connected to the second gate line G2. A drain terminal of the sixth TFT T16 is connected to the third data line D3, and a source terminal thereof is connected to the sixth pixel electrode PIX16.

In the second horizontal display line LINE#2, the first and second LC cells disposed between the first data line D1 and the second data line D2 charge therein data voltages sequentially supplied from the second data line D2. The first TFT T21 in the second horizontal display line transmits the data voltage from the second data line D2 to the first pixel electrode PIX21 in response to the third gate pulse from the third gate line G3. The first pixel electrode PIX21 charges the data voltage therein during about ½ horizontal period. A gate terminal of the first TFT T21 is connected to the third gate line G3. A drain terminal of the first TFT T21 is connected to the second data line D2, and a source terminal thereof is connected to the first pixel electrode PIX21. The second TFT T22 in the second horizontal display line transmits the data voltage from the second data line D2 to the second pixel electrode PIX22 in response to the fourth gate pulse from the fourth gate line G4. The second pixel electrode PIX22 charges the data voltage therein during about ½ horizontal period. A gate terminal of the second TFT T22 is connected to the fourth gate line G4. A drain terminal of the second TFT T22 is connected to the second data line D2, and a source terminal thereof is connected to the second pixel electrode PIX22.

In the second horizontal display line LINE#2, the third and fourth LC cells disposed between the second data line D2 and the third data line D3 charge therein the data voltages sequentially supplied from the third data line D3. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the third data line D3 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the third data line D3, and a source terminal thereof is connected to the fourth pixel electrode PIX24.

In the second horizontal display line LINE#2, the fifth and sixth LC cells disposed between the third data line D3 and the fourth data line D4 charge therein the data voltages sequentially supplied from the fourth data line D4. The fifth TFT T25 in the second horizontal display line transmits the data voltage from the fourth data line D4 to the fifth pixel electrode PIX25 in response to the fourth gate pulse from the fourth gate line G4. The fifth pixel electrode PIX25 charges the data voltage therein during about ½ horizontal period. A gate terminal of the fifth TFT T25 is connected to the fourth gate line G4. A drain terminal of the fifth TFT T25 is connected to the fourth data line D4, and a source terminal thereof is connected to the fifth pixel electrode PIX25. The sixth TFT T26 in the second horizontal display line transmits the data voltage from the fourth data line D4 to the sixth pixel electrode PIX26 in response to the third gate pulse from the third gate line G3. The sixth pixel electrode PIX26 charges the data voltage therein during about ½ horizontal period. A gate terminal of the sixth TFT T26 is connected to the third gate line G3. A drain terminal of the sixth TFT T26 is connected to the fourth data line D4, and a source terminal thereof is connected to the sixth pixel electrode PIX26.

Figure 10:
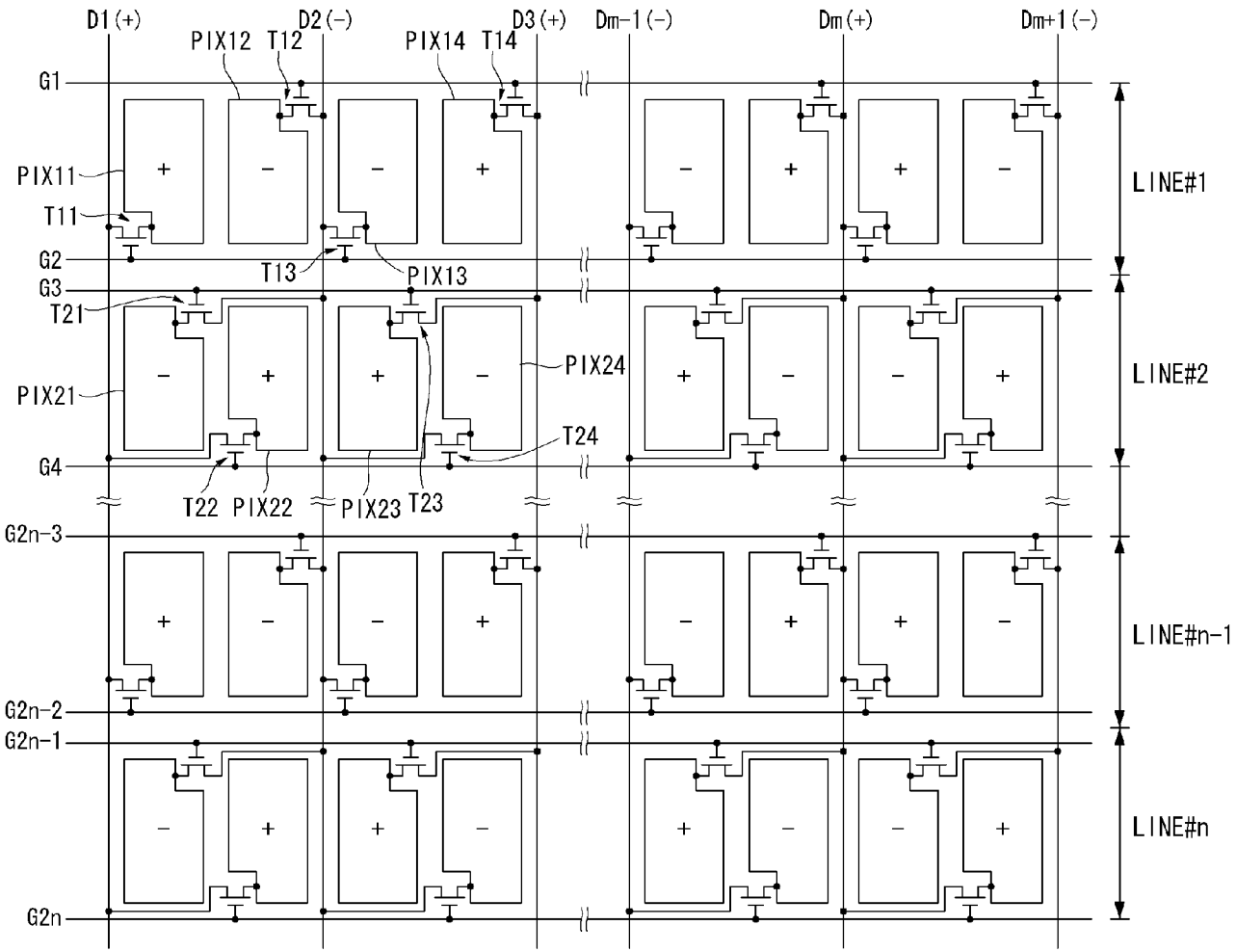
FIG. 10 is a detailed circuit diagram illustrating a fifth embodiment of the pixel array shown in FIG. 1.

FIG. 10 is a circuit diagram illustrating a fifth embodiment of the pixel array 10.

Referring to FIG. 10, the pixel array 10 is provided with data lines D1 to Dm+1, gate lines G1 to G2*n* intersecting the data lines D1 to Dm+1, and TFTs T11 to T14 and T21 to T24 which switch current paths formed between the pixel electrodes PIX11 to PIX14 and PIX21 to PIX24 in LC cells and the data lines D1 to Dm+1 in response to gate pulses. For the data voltages charged in the LC cells due to the pixel array structure in FIG. 10, their polarities are reversed in a unit of horizontal 2-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 10, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 10, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the even-numbered horizontal display lines charge therein the positive data voltages supplied from the i-th data line during the N-th frame period, and thereafter charge therein the negative data voltages supplied from the i-th data line during the (N+1)-th frame period. In FIG. 10, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 10, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

As can be seen from FIG. 10, the second and third LC cells in the odd-numbered horizontal display lines and the first and fourth LC cells in the even-numbered horizontal display lines charge therein the data voltages with the same polarity which are supplied from the (i+1)-th data line. The polarity of the data voltages charged in the second and third cells in the odd-numbered horizontal display lines and the first and fourth LC cells in the even-numbered horizontal display lines is opposite to that of the data voltages charged in the first and fourth LC cells in the odd-numbered horizontal display lines and the second and third LC cells in the even-numbered horizontal display lines.

In the pixel array 10 shown in FIG. 10, connection relations among the TFTs, the pixel electrodes, and the data lines will be described by exemplifying the first to fourth LC cells in the first horizontal display line LINE#1, and the first to fourth LC cells in the second horizontal display line LINE#2.

The second LC cell in the first horizontal display line LINE#1 charges therein the data voltage supplied from the second data line D2. Successively, the first LC cell in the first horizontal display line LINE#1 charges therein the data voltage supplied from the first data line D1. The first TFT T11 in the first horizontal display line transmits the data voltage from the first data line D1 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the second data line D2, and a source terminal thereof is connected to the second pixel electrode PIX12.

The fourth LC cell in the first horizontal display line LINE#1 charges therein the data voltage supplied from the third data line D3. Successively, the third LC cell in the first horizontal display line LINE#1 charges therein the data voltage supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the second TFT T12 is connected to the third data line D3, and a source terminal thereof is connected to the fourth pixel electrode PIX14.

The first LC cell in the second horizontal display line LINE#2 charges therein the data voltage supplied from the second data line D2. Successively, the second LC cell in the second horizontal display line LINE#2 charges therein the data voltage supplied from the first data line D1. The first TFT T21 in the second horizontal display line transmits the data voltage from the second data line D2 to the first pixel electrode PIX21 in response to the third gate pulse from the third gate line G3. The first pixel electrode PIX21 charges the data voltage therein during about ½ horizontal period. A gate terminal of the first TFT T21 is connected to the third gate line G3. A drain terminal of the first TFT T21 is connected to the second data line D2, and a source terminal thereof is connected to the first pixel electrode PIX21. The second TFT T22 in the second horizontal display line transmits the data voltage from the first data line D1 to the second pixel electrode PIX22 in response to the fourth gate pulse from the fourth gate line G4. The second pixel electrode PIX22 charges the data voltage therein during about ½ horizontal period. A gate terminal of the second TFT T22 is connected to the fourth gate line G4. A drain terminal of the second TFT T22 is connected to the first data line D1, and a source terminal thereof is connected to the second pixel electrode PIX22.

The third LC cell in the second horizontal display line LINE#2 charges therein the data voltage supplied from the third data line D3. Successively, the fourth LC cell in the second horizontal display line LINE#2 charges therein the data voltage supplied from the second data line D2. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the second TFT T22 is connected to the second data line D2, and a source terminal thereof is connected to the fourth pixel electrode PIX24.

Figure 11:
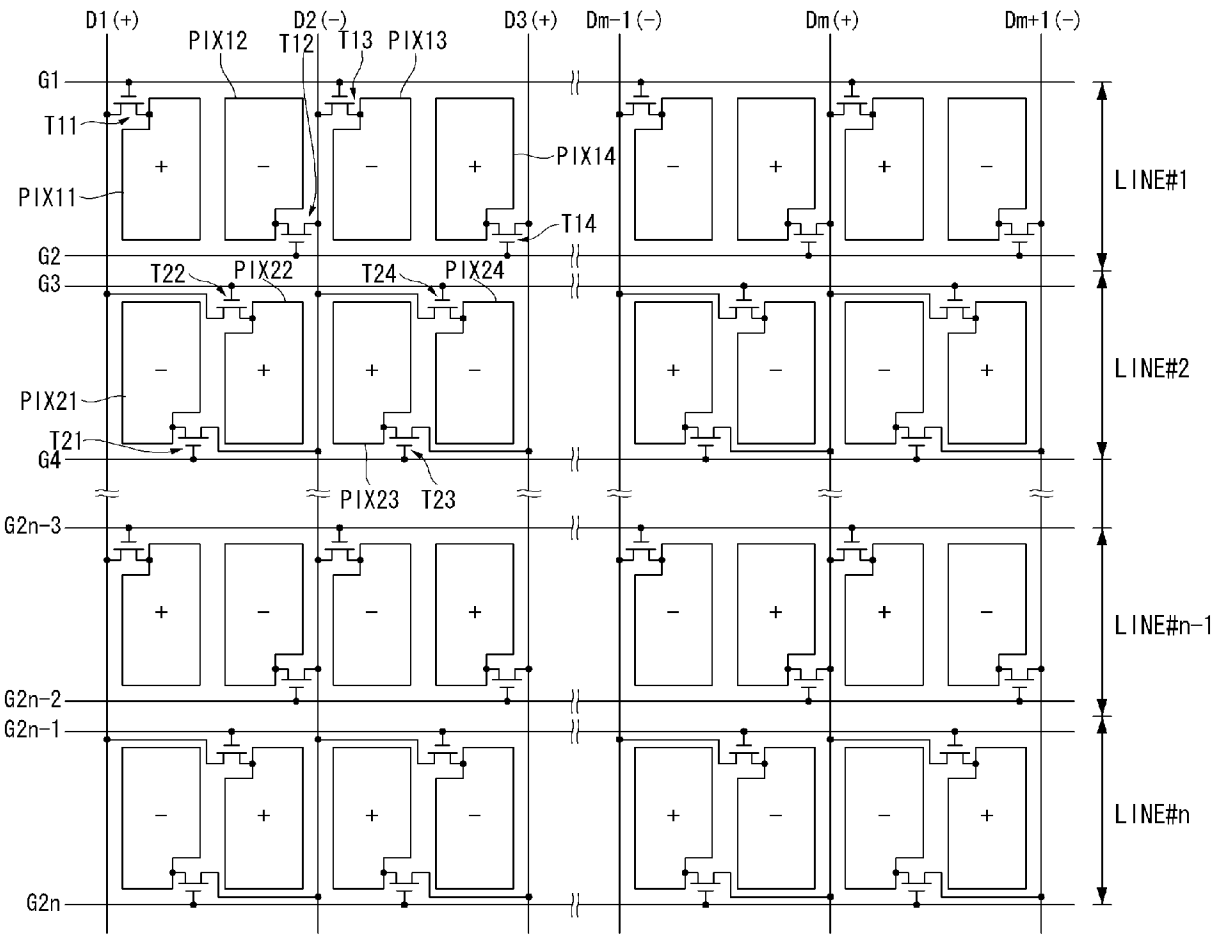
FIG. 11 is a detailed circuit diagram illustrating a sixth embodiment of the pixel array shown in FIG. 1.

FIG. 11 is a circuit diagram illustrating a sixth embodiment of the pixel array 10.

Referring to FIG. 11, the pixel array 10 is provided with data lines D1 to Dm+1, gate lines G1 to G2*n* intersecting the data lines D1 to Dm+1, and TFTs T11 to T14 and T21 to T24 which switch current paths formed between the pixel electrodes PIX11 to PIX14 and PIX21 to PIX24 in LC cells and the data lines D1 to Dm+1 in response to gate pulses. For the data voltages charged in the LC cells due to the pixel array structure in FIG. 11, their polarities are reversed in a unit of horizontal 2-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 11, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 11, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the even-numbered horizontal display lines charge therein the positive data voltages supplied from the i-th data line during the N-th frame period, and thereafter charge therein the negative data voltages supplied from the i-th data line during the (N+1)-th frame period. In FIG. 11, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 11, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

As can be seen from FIG. 11, the second and third LC cells in the odd-numbered horizontal display lines and the first and fourth LC cells in the even-numbered horizontal display lines charge therein the data voltages with the same polarity which are supplied from the (i+1)-th data line. The polarity of the data voltages charged in the second and third cells in the odd-numbered horizontal display lines and the first and fourth LC cells in the even-numbered horizontal display lines is opposite to that of the data voltages charged in the first and fourth LC cells in the odd-numbered horizontal display lines and the second and third LC cells in the even-numbered horizontal display lines.

In the pixel array 10 shown in FIG. 11, connection relations among the TFTs, the pixel electrodes, and the data lines will be described by exemplifying the first to fourth LC cells in the first horizontal display line LINE#1, and the first to fourth LC cells in the second horizontal display line LINE#2.

The first LC cell in the first horizontal display line LINE#1 charges therein the data voltage supplied from the first data line D1. Successively, the second LC cell in the first horizontal display line LINE#1 charges therein the data voltage supplied from the second data line D2. The first TFT T11 in the first horizontal display line transmits the data voltage from the first data line D1 to the first pixel electrode PIX11 in response to the first gate pulse from the first gate line G1. The first pixel electrode PIX11 charges the data voltage therein during about ½ horizontal period. A gate terminal of the first TFT T11 is connected to the first gate line G1. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the second gate pulse from the second gate line G2. The second pixel electrode PIX12 charges the data voltage therein during about ½ horizontal period. A gate terminal of the second TFT T12 is connected to the second gate line G2. A drain terminal of the second TFT T12 is connected to the second data line D2, and a source terminal thereof is connected to the second pixel electrode PIX12.

The third LC cell in the first horizontal display line LINE#1 charges therein the data voltage supplied from the second data line D2. Successively, the fourth LC cell in the first horizontal display line LINE#1 charges therein the data voltage supplied from the third data line D3. The third TFT T13 in the first horizontal display line transmits the data voltage from the second data line D2 to the third pixel electrode PIX13 in response to the first gate pulse from the first gate line G1. The third pixel electrode PIX13 charges the data voltage therein during about ½ horizontal period. A gate terminal of the third TFT T13 is connected to the first gate line G1. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the second gate pulse from the second gate line G2. The fourth pixel electrode PIX14 charges the data voltage therein during about ½ horizontal period. A gate terminal of the fourth TFT T14 is connected to the second gate line G2. A drain terminal of the second TFT T12 is connected to the third data line D3, and a source terminal thereof is connected to the fourth pixel electrode PIX14.

The second LC cell in the second horizontal display line LINE#2 charges therein the data voltage supplied from the first data line D1. Successively, the first LC cell in the second horizontal display line LINE#2 charges therein the data voltage supplied from the second data line D2. The first TFT T21 in the second horizontal display line transmits the data voltage from the second data line D2 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the second data line D2, and a source terminal thereof is connected to the first pixel electrode PIX21. The second TFT T22 in the second horizontal display line transmits the data voltage from the first data line D1 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the first data line D1, and a source terminal thereof is connected to the second pixel electrode PIX22.

The fourth LC cell in the second horizontal display line LINE#2 charges therein the data voltage supplied from the second data line D2. Successively, the third LC cell in the second horizontal display line LINE#2 charges therein the data voltage supplied from the third data line D3. The third TFT T23 in the second horizontal display line transmits the data voltage from the third data line D3 to the third pixel electrode PIX23 in response to the fourth gate pulse from the fourth gate line G4. The third pixel electrode PIX23 charges the data voltage therein during about ½ horizontal period. A gate terminal of the third TFT T23 is connected to the fourth gate line G4. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the third gate pulse from the third gate line G3. The fourth pixel electrode PIX24 charges the data voltage therein during about ½ horizontal period. A gate terminal of the fourth TFT T24 is connected to the third gate line G3. A drain terminal of the second TFT T22 is connected to the second data line D2, and a source terminal thereof is connected to the fourth pixel electrode PIX24.

Figure 12:
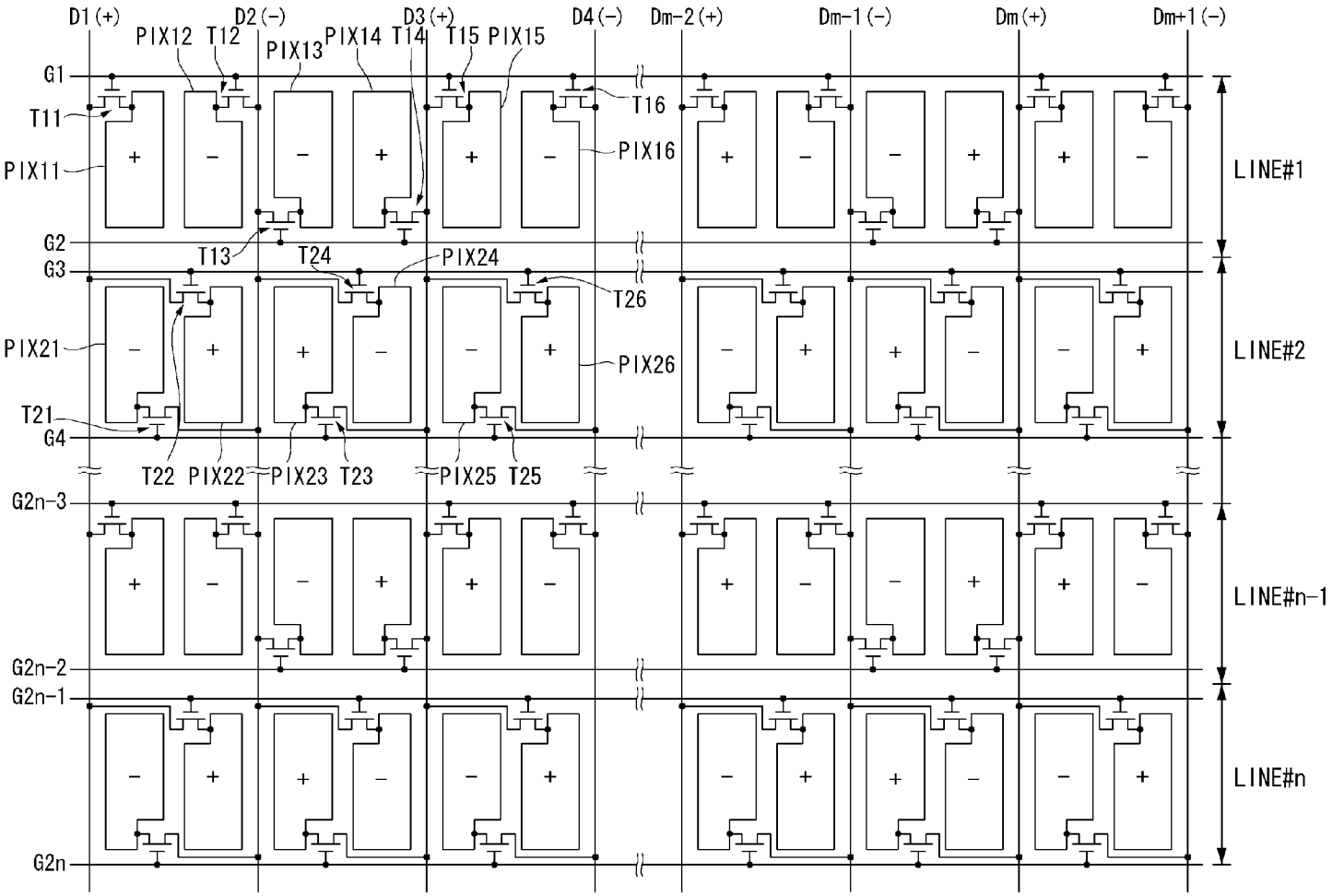
FIG. 12 is a detailed circuit diagram illustrating a seventh embodiment of the pixel array shown in FIG. 1.

FIG. 12 is a circuit diagram illustrating a fourth embodiment of the pixel array 10.

In FIG. 12, the pixel array 10 is provided with data lines D1 to Dm+1, gate lines G1 to G2*n* intersecting the data lines D1 to Dm+1, and TFTs T11 to T16 and T21 to T26 which switch current paths formed between the pixel electrodes PIX11 to PIX16 and PIX21 to PIX26 in LC cells and the data lines D1 to Dm+1 in response to gate pulses. For the data voltages charged in the LC cells due to the pixel array structure in FIG. 12, their polarities are reversed in a unit of horizontal 2-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 12, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 12, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the even-numbered horizontal display lines charge therein the positive data voltages supplied from the i-th data line during the N-th frame period, and thereafter charge therein the negative data voltages supplied from the i-th data line during the (N+1)-th frame period. In FIG. 12, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 12, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

As can be seen from FIG. 12, the second and third LC cells in the odd-numbered horizontal display lines and the first and fourth LC cells in the even-numbered horizontal display lines charge therein the data voltages with the same polarity which are supplied from the (i+1)-th data line. The polarity of the data voltages charged in the second and third LC cells in the odd-numbered horizontal display lines and the first and fourth LC cells in the even-numbered horizontal display lines is opposite to that of the data voltages charged in the first and fourth LC cells in the odd-numbered horizontal display lines and the second and third LC cells in the even-numbered horizontal display lines.

In the pixel array 10 shown in FIG. 12, connection relations among the TFTs, the pixel electrodes, and the data lines will be described by exemplifying the first to fourth LC cells in the first horizontal display line LINE#1, and the first to fourth LC cells in the second horizontal display line LINE#2.

The first LC cell in the first horizontal display line LINE#1 charges therein the data voltage supplied from the first data line D1. At the same time, the second LC cell in the first horizontal display line LINE#1 charges therein the data voltage supplied from the second data line D2. The first TFT T11 in the first horizontal display line transmits the data voltage from the first data line D1 to the first pixel electrode PIX11 in response to the first gate pulse from the first gate line G1. The first pixel electrode PIX11 charges the data voltage therein during about ½ horizontal period. A gate terminal of the first TFT T11 is connected to the first gate line G1. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the second data line D2, and a source terminal thereof is connected to the second pixel electrode PIX12.

The third LC cell in the first horizontal display line LINE#1 charges therein the data voltage supplied from the second data line D2. At the same time, the fourth LC cell in the first horizontal display line LINE#1 charges therein the data voltage supplied from the third data line D3. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the second gate pulse from the second gate line G2. The fourth pixel electrode PIX14 charges the data voltage therein during about ½ horizontal period. A gate terminal of the fourth TFT T14 is connected to the second gate line G2. A drain terminal of the second TFT T12 is connected to the third data line D3, and a source terminal thereof is connected to the fourth pixel electrode PIX14.

The second LC cell in the second horizontal display line LINE#2 charges therein the data voltage supplied from the first data line D1. Successively, the first LC cell in the second horizontal display line LINE#2 charges therein the data voltage supplied from the second data line D2. The first TFT T21 in the second horizontal display line transmits the data voltage from the second data line D2 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the second data line D2, and a source terminal thereof is connected to the first pixel electrode PIX21. The second TFT T22 in the second horizontal display line transmits the data voltage from the first data line D1 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the first data line D1, and a source terminal thereof is connected to the second pixel electrode PIX22.

The fourth LC cell in the second horizontal display line LINE#2 charges therein the data voltage supplied from the second data line D2. Successively, the third LC cell in the second horizontal display line LINE#2 charges therein the data voltage supplied from the third data line D3. The third TFT T23 in the second horizontal display line transmits the data voltage from the third data line D3 to the third pixel electrode PIX23 in response to the fourth gate pulse from the fourth gate line G4. The third pixel electrode PIX23 charges the data voltage therein during about ½ horizontal period. A gate terminal of the third TFT T23 is connected to the fourth gate line G4. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the third gate pulse from the third gate line G3. The fourth pixel electrode PIX24 charges the data voltage therein during about ½ horizontal period. A gate terminal of the fourth TFT T24 is connected to the third gate line G3. A drain terminal of the second TFT T22 is connected to the second data line D2, and a source terminal thereof is connected to the fourth pixel electrode PIX24.

Figure 13:
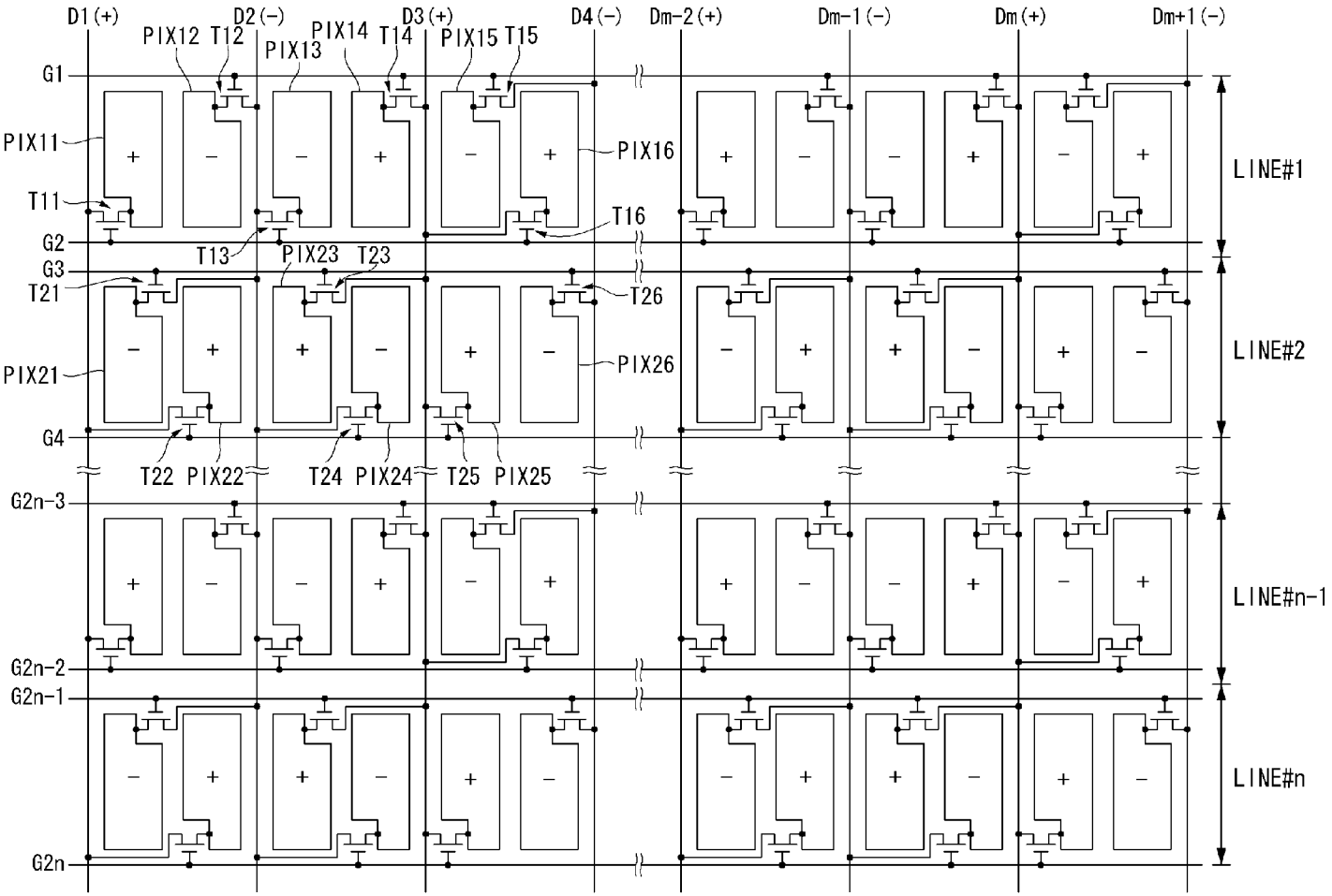
FIG. 13 is a detailed circuit diagram illustrating an eighth embodiment of the pixel array shown in FIG. 1.

FIG. 13 is a circuit diagram illustrating an eighth embodiment of the pixel array 10.

In FIG. 13, the pixel array 10 is provided with data lines D1 to Dm+1, gate lines G1 to G2*n* intersecting the data lines D1 to Dm+1, and TFTs T11 to T16 and T21 to T26 which switch current paths formed between the pixel electrodes PIX11 to PIX16 and PIX21 to PIX26 in LC cells and the data lines D1 to Dm+1 in response to gate pulses. For the data voltages charged in the LC cells due to the pixel array structure in FIG. 13, their polarities are reversed in a unit of horizontal 2-dot and vertical 1-dot. In addition, the polarities of the data voltages charged in a part of the LC cells of the pixel array 10 in FIG. 13 are reversed in a unit of horizontal 1-dot and vertical 1-dot (1×1 dot). Therefore, in the pixel array in FIG. 13, there are mixed the LC cells where the polarities of the data voltages charged therein are reversed in a unit of horizontal 2-dot and vertical 1-dot and in a unit of horizontal 1-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 13, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 13, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In the respective odd-numbered horizontal display lines LINE#1, LINE#3, . . . , and LINE#n−1, fifth and sixth LC cells in the odd-numbered horizontal display lines are disposed between the (i+2)-th data line and a (i+3)-th data line. The fifth LC cells in the odd-numbered horizontal display lines charge therein the negative data voltages supplied from the (i+3)-th data line during the N-th frame period, and thereafter charge therein the positive data voltages supplied from the (i+3)-th data line during the (N+1)-th frame period. The sixth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 13, the reference numeral "PIX15" denotes the fifth pixel electrodes formed in the fifth LC cells in the odd-numbered horizontal display lines, and the reference numeral "PIX16" denotes the sixth pixel electrodes formed in the sixth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the even-numbered horizontal display lines charge therein the positive data voltages supplied from the i-th data line during the N-th frame period, and thereafter charge therein the negative data voltages supplied from the i-th data line during the (N+1)-th frame period. In FIG. 13, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 13, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

In the respective even-numbered horizontal display lines LINE#2, LINE#4, . . . , and LINE#n, fifth and sixth LC cells in the even-numbered horizontal display lines are disposed between the (i+2)-th data line and a (i+3) data line. The fifth LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The sixth LC cells in the even-numbered horizontal display lines charge therein the negative data voltages supplied from the (i+3)-th data line during the N-th frame period, and thereafter charge therein the positive data voltages supplied from the (i+3)-th data line during the (N+1)-th frame period. In FIG. 13, the reference numeral "PIX25" denotes the fifth pixel electrodes formed in the fifth LC cells in the even-numbered horizontal display lines, and the reference numeral "PIX26" denotes the sixth pixel electrodes formed in the sixth LC cells in the even-numbered horizontal display lines.

As can be seen from FIG. 13, the second and third LC cells in the odd-numbered horizontal display lines and the first and fourth LC cells in the even-numbered horizontal display lines charge therein the data voltages with the same polarity which are supplied from the (i+1)-th data line. The polarity of the data voltages charged in the second and third LC cells in the odd-numbered horizontal display lines and the first and fourth LC cells in the even-numbered horizontal display lines is opposite to that of the data voltages charged in the first and fourth LC cells in the odd-numbered horizontal display lines and the second and third LC cells in the even-numbered horizontal display lines. The polarities of the data voltages charged in the first to fourth LC cells in the odd-numbered horizontal display lines and the first to fourth LC cells in the even-numbered horizontal display lines are reversed in a unit of horizontal 2-dot and vertical 1-dot. On the other hand, the polarities of the data voltages charged in the third to sixth LC cells in the odd-numbered horizontal display lines and the third to sixth LC cells in the even-numbered horizontal display lines are reversed in a unit of horizontal 1-dot and vertical 1-dot.

In the pixel array 10 shown in FIG. 13, connection relations among the TFTs, the pixel electrodes, and the data lines will be described by exemplifying the first to sixth LC cells in the first horizontal display line LINE#1, and the first to sixth LC cells in the second horizontal display line LINE#2.

The second LC cell in the first horizontal display line LINE#1 charges therein the data voltage supplied from the second data line D2. Successively, the first LC cell in the first horizontal display line LINE#1 charges therein the data voltage supplied from the first data line D1. The first TFT T11 in the first horizontal display line transmits the data voltage from the first data line D1 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the second data line D2, and a source terminal thereof is connected to the second pixel electrode PIX12.

The fourth LC cell in the first horizontal display line LINE#1 charges therein the data voltage supplied from the third data line D3. Successively, the third LC cell in the first horizontal display line LINE#1 charges therein the data voltage supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the second TFT T12 is connected to the third data line D3, and a source terminal thereof is connected to the fourth pixel electrode PIX14.

The fifth LC cell in the first horizontal display line LINE#1 charges therein the data voltage supplied from the fourth data line D4. Successively, the sixth LC cell in the first horizontal display line LINE#1 charges therein the data voltage supplied from the third data line D3. The fifth TFT T15 in the first horizontal display line transmits the data voltage from the fourth data line D4 to the fifth pixel electrode PIX15 in response to the first gate pulse from the first gate line G1. The fifth pixel electrode PIX15 charges the data voltage therein during about ½ horizontal period. A gate terminal of the fifth TFT T15 is connected to the first gate line G1. A drain terminal of the fifth TFT T15 is connected to the fourth data line D4, and a source terminal thereof is connected to the fifth pixel electrode PIX15. The sixth TFT T16 in the first horizontal display line transmits the data voltage from the third data line D3 to the sixth pixel electrode PIX16 in response to the second gate pulse from the second gate line G2. The sixth pixel electrode PIX16 charges the data voltage therein during about ½ horizontal period. A gate terminal of the sixth TFT T16 is connected to the second gate line G2. A drain terminal of the second TFT T12 is connected to the third data line D3, and a source terminal thereof is connected to the sixth pixel electrode PIX16.

The first LC cell in the second horizontal display line LINE#2 charges therein the data voltage supplied from the second data line D2. Successively, the second LC cell in the second horizontal display line LINE#2 charges therein the data voltage supplied from the first data line D1. The first TFT T21 in the second horizontal display line transmits the data voltage from the second data line D2 to the first pixel electrode PIX21 in response to the third gate pulse from the third gate line G3. The first pixel electrode PIX21 charges the data voltage therein during about ½ horizontal period. A gate terminal of the first TFT T21 is connected to the third gate line G3. A drain terminal of the first TFT T21 is connected to the second data line D2, and a source terminal thereof is connected to the first pixel electrode PIX21. The second TFT T22 in the second horizontal display line transmits the data voltage from the first data line D1 to the second pixel electrode PIX22 in response to the fourth gate pulse from the fourth gate line G4. The second pixel electrode PIX22 charges the data voltage therein during about ½ horizontal period. A gate terminal of the second TFT T22 is connected to the fourth gate line G4. A drain terminal of the second TFT T22 is connected to the first data line D1, and a source terminal thereof is connected to the second pixel electrode PIX22.

The third LC cell in the second horizontal display line LINE#2 charges therein the data voltage supplied from the third data line D3. Successively, the fourth LC cell in the second horizontal display line LINE#2 charges therein the data voltage supplied from the second data line D2. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the second data line D2, and a source terminal thereof is connected to the fourth pixel electrode PIX24.

The sixth LC cell in the second horizontal display line LINE#2 charges therein the data voltage supplied from the fourth data line D4. Successively, the fifth LC cell in the second horizontal display line LINE#2 charges therein the data voltage supplied from the third data line D3. The fifth TFT T25 in the second horizontal display line transmits the data voltage from the third data line D3 to the fifth pixel electrode PIX25 in response to the fourth gate pulse from the fourth gate line G4. The fifth pixel electrode PIX25 charges the data voltage therein during about ½ horizontal period. A gate terminal of the fifth TFT T25 is connected to the fourth gate line G4. A drain terminal of the fifth TFT T25 is connected to the third data line D3, and a source terminal thereof is connected to the fifth pixel electrode PIX25. The sixth TFT T26 in the second horizontal display line transmits the data voltage from the fourth data line D4 to the sixth pixel electrode PIX26 in response to the third gate pulse from the third gate line G3. The sixth pixel electrode PIX26 charges the data voltage therein during about ½ horizontal period. A gate terminal of the sixth TFT T26 is connected to the third gate line G3. A drain terminal of the sixth TFT T26 is connected to the fourth data line D4, and a source terminal thereof is connected to the sixth pixel electrode PIX26.

Figure 14:
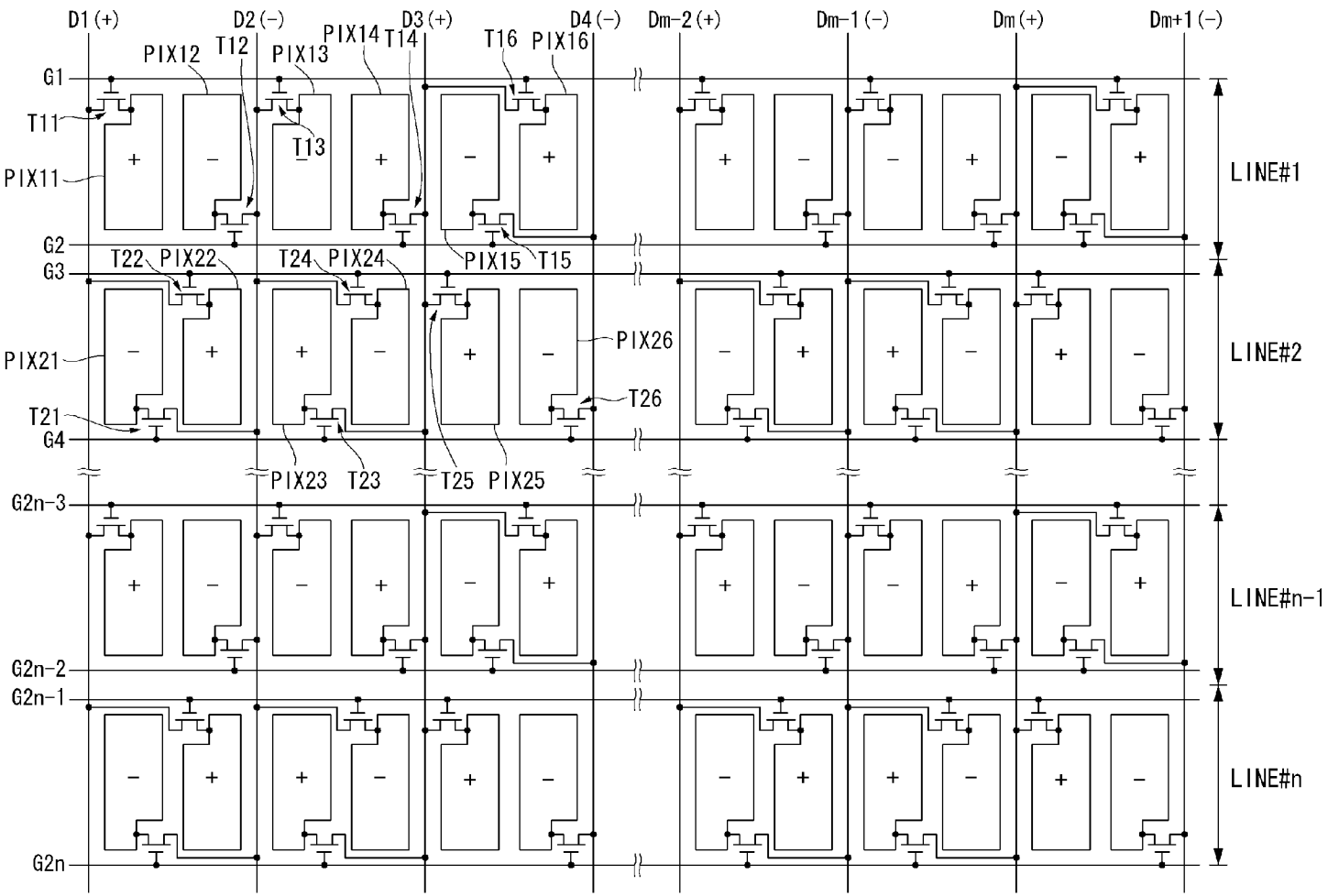
FIG. 14 is a detailed circuit diagram illustrating a ninth embodiment of the pixel array shown in FIG. 1.

FIG. 14 is a circuit diagram illustrating a ninth embodiment of the pixel array 10.

In FIG. 14, the pixel array 10 is provided with data lines D1 to Dm+1, gate lines G1 to Gln intersecting the data lines D1 to Dm+1, and TFTs T11 to T16 and T21 to T26 which switch current paths formed between the pixel electrodes PIX11 to PIX16 and PIX21 to PIX26 in LC cells and the data lines D1 to Dm+1 in response to gate pulses. For the data voltages charged in the LC cells due to the pixel array structure in FIG. 14, their polarities are reversed in a unit of horizontal 2-dot and vertical 1-dot. In addition, the polarities of the data voltages charged in a part of the LC cells of the pixel array 10 in FIG. 14 are reversed in a unit of horizontal 1-dot and vertical 1-dot. Therefore, in the pixel array in FIG. 14, there are mixed the LC cells where the polarities of the data voltages charged therein are reversed in a unit of horizontal 2-dot and vertical 1-dot and in a unit of horizontal 1-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period.

In FIG. 14, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 14, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In the respective odd-numbered horizontal display lines LINE#1, LINE#3, . . . , and LINE#n−1, fifth and sixth LC cells in the odd-numbered horizontal display lines are disposed between the (i+2)-th data line and a (i+3)-th data line. The fifth LC cells in the odd-numbered horizontal display lines charge therein the negative data voltages supplied from the (i+3)-th data line during the N-th frame period, and thereafter charge therein the positive data voltages supplied from the (i+3)-th data line during the (N+1)-th frame period. The sixth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 14, the reference numeral "PIX15" denotes the fifth pixel electrodes formed in the fifth LC cells in the odd-numbered horizontal display lines, and the reference numeral "PIX16" denotes the sixth pixel electrodes formed in the sixth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the even-numbered horizontal display lines charge therein the positive data voltages supplied from the i-th data line during the N-th frame period, and thereafter charge therein the negative data voltages supplied from the i-th data line during the (N+1)-th frame period. In FIG. 14, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 14, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

In the respective even-numbered horizontal display lines LINE#2, LINE#4, . . . , and LINE#n, fifth and sixth LC cells in the even-numbered horizontal display lines are disposed between the (i+2)-th data line and a (i+3) data line. The fifth LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The sixth LC cells in the even-numbered horizontal display lines charge therein the negative data voltages supplied from the (i+3)-th data line during the N-th frame period, and thereafter charge therein the positive data voltages supplied from the (i+3)-th data line during the (N+1)-th frame period. In FIG. 14, the reference numeral "PIX25" denotes the fifth pixel electrodes formed in the fifth LC cells in the even-numbered horizontal display lines, and the reference numeral "PIX26" denotes the sixth pixel electrodes formed in the sixth LC cells in the even-numbered horizontal display lines.

As can be seen from FIG. 14, the second and third LC cells in the odd-numbered horizontal display lines and the first and fourth LC cells in the even-numbered horizontal display lines charge therein the data voltages with the same polarity which are supplied from the (i+1)-th data line. The polarity of the data voltages charged in the second and third LC cells in the odd-numbered horizontal display lines and the first and fourth LC cells in the even-numbered horizontal display lines is opposite to that of the data voltages charged in the first and fourth LC cells in the odd-numbered horizontal display lines and the second and third LC cells in the even-numbered horizontal display lines. The polarities of the data voltages charged in the first to fourth LC cells in the odd-numbered horizontal display lines and the first to fourth LC cells in the even-numbered horizontal display lines are reversed in a unit of horizontal 2-dot and vertical 1-dot. On the other hand, the polarities of the data voltages charged in the third to sixth LC cells in the odd-numbered horizontal display lines and the third to sixth LC cells in the even-numbered horizontal display lines are reversed in a unit of horizontal 1-dot and vertical 1-dot.

In the pixel array 10 shown in FIG. 14, connection relations among the TFTs, the pixel electrodes, and the data lines will be described by exemplifying the first to sixth LC cells in the first horizontal display line LINE#1, and the first to sixth LC cells in the second horizontal display line LINE#2.

The first LC cell in the first horizontal display line LINE#1 charges therein the data voltage supplied from the first data line D1. Successively, the second LC cell in the first horizontal display line LINE#1 charges therein the data voltage supplied from the second data line D2. The first TFT T11 in the first horizontal display line transmits the data voltage from the first data line D1 to the first pixel electrode PIX11 in response to the first gate pulse from the first gate line G1. The first pixel electrode PIX11 charges the data voltage therein during about ½ horizontal period. A gate terminal of the first TFT T11 is connected to the first gate line G1. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the second gate pulse from the second gate line G2. The second pixel electrode PIX12 charges the data voltage therein during about ½ horizontal period. A gate terminal of the second TFT T12 is connected to the second gate line G2. A drain terminal of the second TFT T12 is connected to the second data line D2, and a source terminal thereof is connected to the second pixel electrode PIX12.

The third LC cell in the first horizontal display line LINE#1 charges therein the data voltage supplied from the second data line D2. Successively, the fourth LC cell in the first horizontal display line LINE#1 charges therein the data voltage supplied from the third data line D3. The third TFT T13 in the first horizontal display line transmits the data voltage from the second data line D2 to the third pixel electrode PIX13 in response to the first gate pulse from the first gate line G1. The third pixel electrode PIX13 charges the data voltage therein during about ½ horizontal period. A gate terminal of the third TFT T13 is connected to the first gate line G1. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the second gate pulse from the second gate line G2. The fourth pixel electrode PIX14 charges the data voltage therein during about ½ horizontal period. A gate terminal of the fourth TFT T14 is connected to the second gate line G2. A drain terminal of the fourth TFT T14 is connected to the third data line D3, and a source terminal thereof is connected to the fourth pixel electrode PIX14.

The sixth LC cell in the first horizontal display line LINE#1 charges therein the data voltage supplied from the third data line D3. Successively, the fifth LC cell in the first horizontal display line LINE#1 charges therein the data voltage supplied from the fourth data line D4. The fifth TFT T15 in the first horizontal display line transmits the data voltage from the fourth data line D4 to the fifth pixel electrode PIX15 in response to the second gate pulse from the second gate line G2. The fifth pixel electrode PIX15 charges the data voltage therein during about ½ horizontal period. A gate terminal of the fifth TFT T15 is connected to the second gate line G2. A drain terminal of the fifth TFT T15 is connected to the fourth data line D4, and a source terminal thereof is connected to the fifth pixel electrode PIX15. The sixth TFT T16 in the first horizontal display line transmits the data voltage from the third data line D3 to the sixth pixel electrode PIX16 in response to the first gate pulse from the first gate line G1. The sixth pixel electrode PIX16 charges the data voltage therein during about ½ horizontal period. A gate terminal of the sixth TFT T16 is connected to the first gate line G1. A drain terminal of the second TFT T12 is connected to the third data line D3, and a source terminal thereof is connected to the sixth pixel electrode PIX16.

The second LC cell in the second horizontal display line LINE#2 charges therein the data voltage supplied from the first data line D1. Successively, the first LC cell in the second horizontal display line LINE#2 charges therein the data voltage supplied from the second data line D2. The first TFT T21 in the second horizontal display line transmits the data voltage from the second data line D2 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the second data line D2, and a source terminal thereof is connected to the first pixel electrode PIX21. The second TFT T22 in the second horizontal display line transmits the data voltage from the first data line D1 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the first data line D1, and a source terminal thereof is connected to the second pixel electrode PIX22.

The fourth LC cell in the second horizontal display line LINE#2 charges therein the data voltage supplied from the second data line D2. Successively, the third LC cell in the second horizontal display line LINE#2 charges therein the data voltage supplied from the third data line D3. The third TFT T23 in the second horizontal display line transmits the data voltage from the third data line D3 to the third pixel electrode PIX23 in response to the fourth gate pulse from the fourth gate line G4. The third pixel electrode PIX23 charges the data voltage therein during about ½ horizontal period. A gate terminal of the third TFT T23 is connected to the fourth gate line G4. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the third gate pulse from the third gate line G3. The fourth pixel electrode PIX24 charges the data voltage therein during about ½ horizontal period. A gate terminal of the fourth TFT T24 is connected to the third gate line G3. A drain terminal of the fourth TFT T24 is connected to the second data line D2, and a source terminal thereof is connected to the fourth pixel electrode PIX24.

The fifth LC cell in the second horizontal display line LINE#2 charges therein the data voltage supplied from the third data line D3. Successively, the sixth LC cell in the second horizontal display line LINE#2 charges therein the data voltage supplied from the fourth data line D4. The fifth TFT T25 in the second horizontal display line transmits the data voltage from the third data line D3 to the fifth pixel electrode PIX25 in response to the third gate pulse from the third gate line G3. The fifth pixel electrode PIX25 charges the data voltage therein during about ½ horizontal period. A gate terminal of the fifth TFT T25 is connected to the third gate line G3. A drain terminal of the fifth TFT T25 is connected to the third data line D3, and a source terminal thereof is connected to the fifth pixel electrode PIX25. The sixth TFT T26 in the second horizontal display line transmits the data voltage from the fourth data line D4 to the sixth pixel electrode PIX26 in response to the fourth gate pulse from the fourth gate line G4. The sixth pixel electrode PIX26 charges the data voltage therein during about ½ horizontal period. A gate terminal of the sixth TFT T26 is connected to the fourth gate line G4. A drain terminal of the sixth TFT T26 is connected to the fourth data line D4, and a source terminal thereof is connected to the sixth pixel electrode PIX26.

Figure 15:
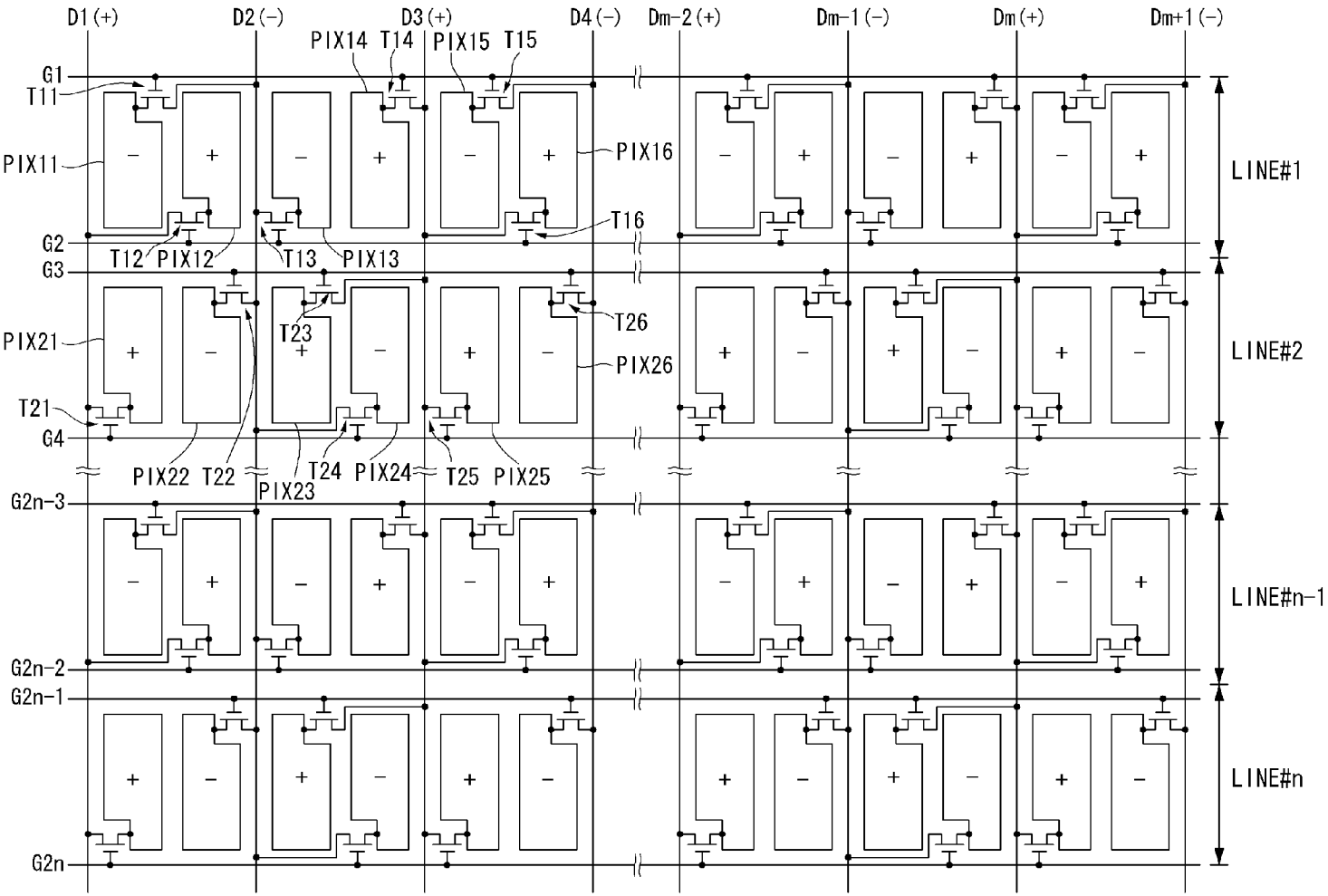
FIG. 15 is a detailed circuit diagram illustrating a tenth embodiment of the pixel array shown in FIG. 1.

FIG. 15 is a circuit diagram illustrating a tenth embodiment of the pixel array 10.

In FIG. 15, the pixel array 10 is provided with data lines D1 to Dm+1, gate lines G1 to G2*n* intersecting the data lines D1 to Dm+1, and TFTs T11 to T16 and T21 to T26 which switch current paths formed between the pixel electrodes PIX11 to PIX16 and PIX21 to PIX26 in LC cells and the data lines D1 to Dm+1 in response to gate pulses. For the data voltages charged in the LC cells due to the pixel array structure in FIG. 15, their polarities are reversed in a unit of horizontal 1-dot and vertical 1-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, D3, . . . , Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The second LC cells in the odd-numbered horizontal display lines charge therein the positive data voltages supplied from the i-th data line during the N-th frame period, and thereafter charge therein the negative data voltages supplied from the i-th data line during the (N+1)-th frame period. In FIG. 15, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. The fourth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 15, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In the respective odd-numbered horizontal display lines LINE#1, LINE#3, . . . , and LINE#n−1, fifth and sixth LC cells in the odd-numbered horizontal display lines are disposed between the (i+2)-th data line and a (i+3)-th data line. The fifth LC cells in the odd-numbered horizontal display lines charge therein the negative data voltages supplied from the (i+3)-th data line during the N-th frame period, and thereafter charge therein the positive data voltages supplied from the (i+3)-th data line during the (N+1)-th frame period. The sixth LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. In FIG. 15, the reference numeral "PIX15" denotes the fifth pixel electrodes formed in the fifth LC cells in the odd-numbered horizontal display lines, and the reference numeral "PIX16" denotes the sixth pixel electrodes formed in the sixth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the positive data voltages supplied from the i-th data line during the N-th frame period, and thereafter charge therein negative data voltages the supplied from the i-th data line during the (N+1)-th frame period. The second LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 15, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 15, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

In the respective even-numbered horizontal display lines LINE#2, LINE#4, . . . , and LINE#n, fifth and sixth LC cells in the even-numbered horizontal display lines are disposed between the (i+2)-th data line and a (i+3) data line. The fifth LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The sixth LC cells in the even-numbered horizontal display lines charge therein the negative data voltages supplied from the (i+3)-th data line during the N-th frame period, and thereafter charge therein the positive data voltages supplied from the (i+3)-th data line during the (N+1)-th frame period. In FIG. 15, the reference numeral "PIX25" denotes the fifth pixel electrodes formed in the fifth LC cells in the even-numbered horizontal display lines, and the reference numeral "PIX26" denotes the sixth pixel electrodes formed in the sixth LC cells in the even-numbered horizontal display lines.

As can be seen from FIG. 15, the LC cells adjacent to each other in the vertical direction as well as the LC cells adjacent to each other in the horizontal direction charge therein the data voltages with the polarities opposite to each other. Therefore, the LC cells of the pixel array in FIG. 15 charge therein the data voltages of which the polarities are reversed in a unit of horizontal 1-dot and vertical 1-dot.

In the pixel array 10 shown in FIG. 15, connection relations among the TFTs, the pixel electrodes, and the data lines will be described by exemplifying the first to fourth LC cells in the first horizontal display line LINE#1, and the first to fourth LC cells in the second horizontal display line LINE#2.

The first LC cell in the first horizontal display line LINE#1 charges therein the data voltage supplied from the second data line D2. Successively, the second LC cell in the first horizontal display line LINE#1 charges therein the data voltage supplied from the first data line D1. The first TFT T11 in the first horizontal display line transmits the data voltage from the second data line D2 to the first pixel electrode PIX11 in response to the first gate pulse from the first gate line G1. The first pixel electrode PIX11 charges the data voltage therein during about ½ horizontal period. A gate terminal of the first TFT T11 is connected to the first gate line G1. A drain terminal of the first TFT T11 is connected to the second data line D2, and a source terminal thereof is connected to the first pixel electrode PIX11. The second TFT T12 in the first horizontal display line transmits the data voltage from the first data line D1 to the second pixel electrode PIX12 in response to the second gate pulse from the second gate line G2. The second pixel electrode PIX12 charges the data voltage therein during about ½ horizontal period. A gate terminal of the second TFT T12 is connected to the second gate line G2. A drain terminal of the second TFT T12 is connected to the first data line D1, and a source terminal thereof is connected to the second pixel electrode PIX12.

The fourth LC cell in the first horizontal display line LINE#1 charges therein the data voltage supplied from the third data line D3. Successively, the third LC cell in the first horizontal display line LINE#1 charges therein the data voltage supplied from the second data line D2. The third TFT T13 in the first horizontal display line transmits the data voltage from the second data line D2 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the second data line D2, and a source terminal thereof is connected to the third pixel electrode PIX13. The fourth TFT T14 in the first horizontal display line transmits the data voltage from the third data line D3 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the third data line D3, and a source terminal thereof is connected to the fourth pixel electrode PIX14.

The second LC cell in the second horizontal display line LINE#2 charges therein the data voltage supplied from the second data line D2. Successively, the first LC cell in the second horizontal display line LINE#2 charges therein the data voltage supplied from the first data line D1. The first TFT T21 in the second horizontal display line transmits the data voltage from the first data line D1 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the first data line D1, and a source terminal thereof is connected to the first pixel electrode PIX21. The second TFT T22 in the second horizontal display line transmits the data voltage from the second data line D2 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the second data line D2, and a source terminal thereof is connected to the second pixel electrode PIX22.

The third LC cell in the second horizontal display line LINE#2 charges therein the data voltage supplied from the third data line D3. Successively, the fourth LC cell in the second horizontal display line LINE#2 charges therein the data voltage supplied from the second data line D2. The third TFT T23 in the second horizontal display line transmits the data voltage from the third data line D3 to the third pixel electrode PIX23 in response to the third gate pulse from the third gate line G3. The third pixel electrode PIX23 charges the data voltage therein during about ½ horizontal period. A gate terminal of the third TFT T23 is connected to the third gate line G3. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the fourth gate pulse from the fourth gate line G4. The fourth pixel electrode PIX24 charges the data voltage therein during about ½ horizontal period. A gate terminal of the fourth TFT T24 is connected to the fourth gate line G4. A drain terminal of the fourth TFT T24 is connected to the second data line D2, and a source terminal thereof is connected to the fourth pixel electrode PIX24.

Figure 16:
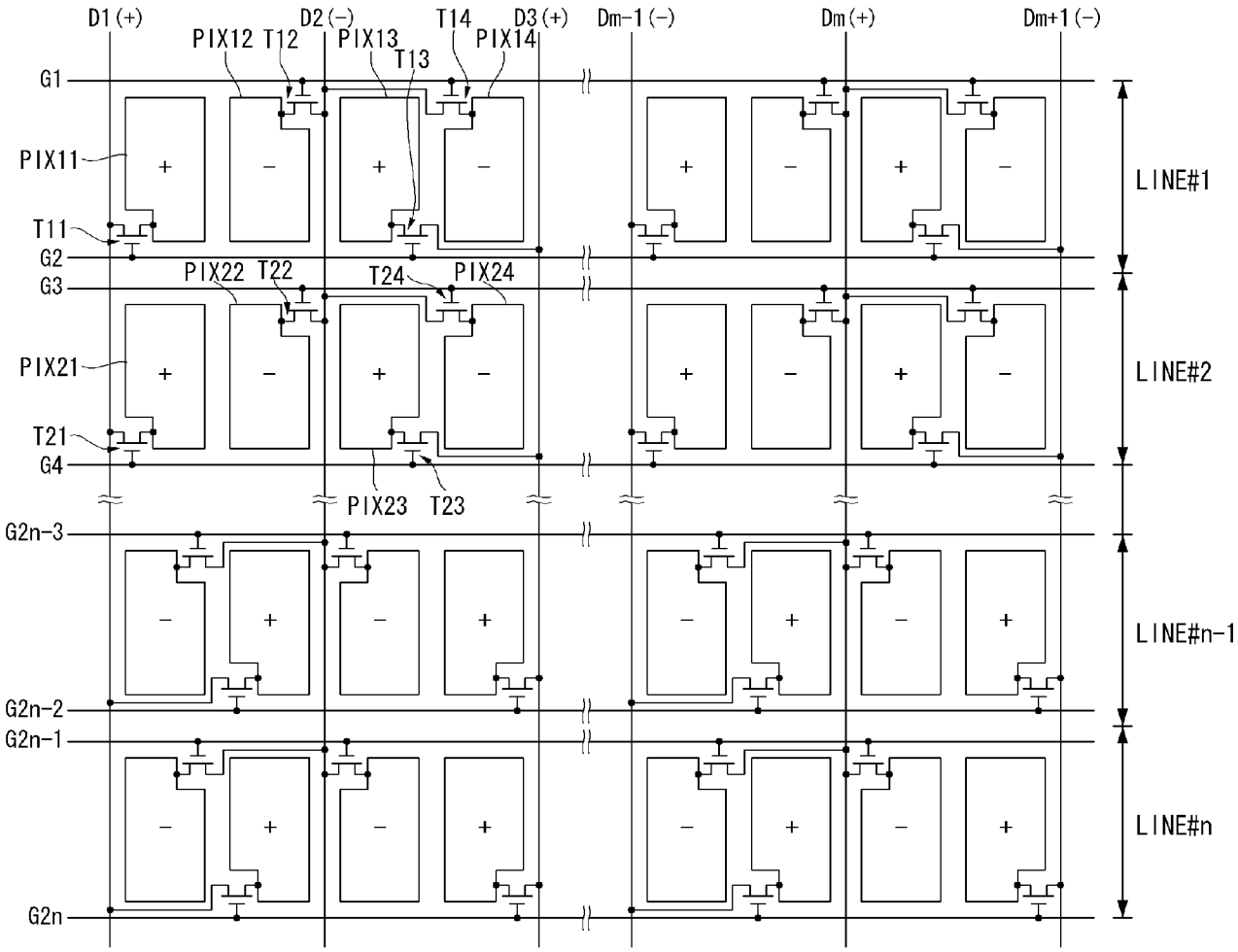
FIG. 16 is a detailed circuit diagram illustrating an eleventh embodiment of the pixel array shown in FIG. 1.

FIG. 16 is a circuit diagram illustrating an eleventh embodiment of the pixel array 10.

In FIG. 16, the pixel array 10 is provided with data lines D1 to Dm+1, gate lines G1 to G2*n* intersecting the data lines D1 to Dm+1, and TFTs T11 to T14 and T21 to T24 which switch current paths formed between the pixel electrodes PIX11 to PIX14 and PIX21 to PIX24 in LC cells and the data lines D1 to Dm+1 in response to gate pulses. For the data voltages charged in the LC cells due to the pixel array structure in FIG. 16, their polarities are reversed in a unit of horizontal 1-dot and vertical 2-dot.

The source drive ICs 12 output to the data lines D1 to Dm+1 the data voltages of which the polarities are reversed by the column inversion scheme. The gate drivers 13 sequentially supply the gate pulses for the first to 2n-th gate lines G1 to G2*n*. A first gate pulse is provided to the first gate line G1, and then second to 2n-th gate pulses are provided to the second to 2n-th gate lines G2 to G2*n*.

During an N-th frame period, the source drive ICs 12 supply only positive data voltages for the odd-numbered data lines D1, D3, . . . , Dm−1 and Dm+1, and supply only negative data voltages for the even-numbered data lines D2, D4, . . . , and Dm. During a (N+1)-th frame period, the source drive ICs 12 supply only the negative data voltages for the odd-numbered data lines D1, Dm−1 and Dm+1, and supply only the positive data voltages for the even-numbered data lines D2, D4, . . . , and Dm.

In the respective odd-numbered horizontal display lines LINE#1, LINE#3, . . . , and LINE#n−1, first and second LC cells in the odd-numbered horizontal display lines are disposed between an i-th data line and a (i+1)-th data line. The first LC cells in the odd-numbered horizontal display lines charge therein the positive data voltages supplied from the i-th data line during the N-th frame period, and thereafter charge therein the negative data voltages supplied from the i-th data line during the (N+1)-th frame period. The second LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 16, the reference numeral "PIX11" denotes the first pixel electrodes formed in the first LC cells in the odd-numbered horizontal display lines, and the reference numeral "PIX12" denotes the second pixel electrodes formed in the second LC cells in the odd-numbered horizontal display lines.

In the respective odd-numbered horizontal display lines LINE#1, LINE#3, . . . , and LINE#n−1, third and fourth LC cells in the odd-numbered horizontal display lines are disposed between the (i+1)-th data line and a (i+2)-th data line. The third LC cells in the odd-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the odd-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 16, the reference numeral "PIX13" denotes the third pixel electrodes formed in the third LC cells in the odd-numbered horizontal display lines, and the reference numeral "PIX14" denotes the fourth pixel electrodes formed in the fourth LC cells in the odd-numbered horizontal display lines.

In The respective even-numbered horizontal display lines LINE#2, LINE#4, . . . , and LINE#n, first and second LC cells in the even-numbered horizontal display lines are disposed between the i-th data line and the (i+1) data line. The first LC cells in the even-numbered horizontal display lines charge therein the positive data voltages supplied from the i-th data line during the N-th frame period, and thereafter charge therein negative data voltages the supplied from the i-th data line during the (N+1)-th frame period. The second LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 16, the reference numeral "PIX21" denotes the first pixel electrodes formed in the first LC cells in the even-numbered horizontal display lines, and the reference numeral "PIX22" denotes the second pixel electrodes formed in the second LC cells in the even-numbered horizontal display lines.

In the respective even-numbered horizontal display lines LINE#2, LINE#4, . . . , and LINE#n, third and fourth LC cells in the even-numbered horizontal display lines are disposed between the (i+1)-th data line and a (i+2) data line. The third LC cells in the even-numbered horizontal display lines charge therein the positive data voltages supplied from the (i+2)-th data line during the N-th frame period, and thereafter charge therein the negative data voltages supplied from the (i+2)-th data line during the (N+1)-th frame period. The fourth LC cells in the even-numbered horizontal display lines charge therein the negative data voltages supplied from the (i+1)-th data line during the N-th frame period, and thereafter charge therein the positive data voltages supplied from the (i+1)-th data line during the (N+1)-th frame period. In FIG. 16, the reference numeral "PIX23" denotes the third pixel electrodes formed in the third LC cells in the even-numbered horizontal display lines, and the reference numeral "PIX24" denotes the fourth pixel electrodes formed in the fourth LC cells in the even-numbered horizontal display lines.

As can be seen from FIG. 16, the polarities of the data voltages charged in the LC cells adjacent to each other in the vertical direction are reversed in a unit of 2-dot (or LC cell), and the polarities of the data voltages charged in the LC cells adjacent to each other in the horizontal direction are reversed in a unit of 1-dot. Therefore, the LC cells of the pixel array in FIG. 16 charge the data voltages of which the polarities are reversed in a unit of horizontal 1-dot and vertical 2-dot (2×1 dots).

In the pixel array 10 shown in FIG. 16, connection relations among the TFTs, the pixel electrodes, and the data lines will be described by exemplifying the first to fourth LC cells in the first horizontal display line LINE#1, and the first to fourth LC cells in the second horizontal display line LINE#2.

The second LC cell in the first horizontal display line LINE#1 charges therein the data voltage supplied from the second data line D2. Successively, the first LC cell in the first horizontal display line LINE#1 charges therein the data voltage supplied from the first data line D1. The first TFT T11 in the first horizontal display line transmits the data voltage from the first data line D1 to the first pixel electrode PIX11 in response to the second gate pulse from the second gate line G2. The first pixel electrode PIX11 charges the data voltage therein during about ½ horizontal period. A gate terminal of the first TFT T11 is connected to the second gate line G2. A drain terminal of the first TFT T11 is connected to the first data line D1, and a source terminal thereof is connected to the first pixel electrode PIX11. The second TFT T12 in the first horizontal display line transmits the data voltage from the second data line D2 to the second pixel electrode PIX12 in response to the first gate pulse from the first gate line G1. The second pixel electrode PIX12 charges the data voltage therein during about ½ horizontal period. A gate terminal of the second TFT T12 is connected to the first gate line G1. A drain terminal of the second TFT T12 is connected to the second data line D2, and a source terminal thereof is connected to the second pixel electrode PIX12.

The fourth LC cell in the first horizontal display line LINE#1 charges therein the data voltage supplied from the second data line D2. Successively, the third LC cell in the first horizontal display line LINE#1 charges therein the data voltage supplied from the third data line D3. The third TFT T13 in the first horizontal display line transmits the data voltage from the third data line D3 to the third pixel electrode PIX13 in response to the second gate pulse from the second gate line G2. The third pixel electrode PIX13 charges the data voltage therein during about ½ horizontal period. A gate terminal of the third TFT T13 is connected to the second gate line G2. A drain terminal of the third TFT T13 is connected to the third data line D3, and a source terminal thereof is connected to the third pixel electrode PIX13. The fourth TFT T14 in the first horizontal display line transmits the data voltage from the second data line D2 to the fourth pixel electrode PIX14 in response to the first gate pulse from the first gate line G1. The fourth pixel electrode PIX14 charges the data voltage therein during about ½ horizontal period. A gate terminal of the fourth TFT T14 is connected to the first gate line G1. A drain terminal of the fourth TFT T14 is connected to the second data line D2, and a source terminal thereof is connected to the fourth pixel electrode PIX14.

The second LC cell in the second horizontal display line LINE#2 charges therein the data voltage supplied from the second data line D2. Successively, the first LC cell in the second horizontal display line LINE#2 charges therein the data voltage supplied from the first data line D1. The first TFT T21 in the second horizontal display line transmits the data voltage from the first data line D1 to the first pixel electrode PIX21 in response to the fourth gate pulse from the fourth gate line G4. The first pixel electrode PIX21 charges the data voltage therein during about ½ horizontal period. A gate terminal of the first TFT T21 is connected to the fourth gate line G4. A drain terminal of the first TFT T21 is connected to the first data line D1, and a source terminal thereof is connected to the first pixel electrode PIX21. The second TFT T22 in the second horizontal display line transmits the data voltage from the second data line D2 to the second pixel electrode PIX22 in response to the third gate pulse from the third gate line G3. The second pixel electrode PIX22 charges the data voltage therein during about ½ horizontal period. A gate terminal of the second TFT T22 is connected to the third gate line G3. A drain terminal of the second TFT T22 is connected to the second data line D2, and a source terminal thereof is connected to the second pixel electrode PIX22.

The fourth LC cell in the second horizontal display line LINE#2 charges therein the data voltage supplied from the second data line D2. Successively, the third LC cell in the second horizontal display line LINE#2 charges therein the data voltage supplied from the third data line D3. The third TFT T23 in the second horizontal display line transmits the data voltage from the third data line D3 to the third pixel electrode PIX23 in response to the fourth gate pulse from the fourth gate line G4. The third pixel electrode PIX23 charges the data voltage therein during about ½ horizontal period. A gate terminal of the third TFT T23 is connected to the fourth gate line G4. A drain terminal of the third TFT T23 is connected to the third data line D3, and a source terminal thereof is connected to the third pixel electrode PIX23. The fourth TFT T24 in the second horizontal display line transmits the data voltage from the second data line D2 to the fourth pixel electrode PIX24 in response to the third gate pulse from the third gate line G3. The fourth pixel electrode PIX24 charges the data voltage therein during about ½ horizontal period. A gate terminal of the fourth TFT T24 is connected to the third gate line G3. A drain terminal of the fourth TFT T24 is connected to the second data line D2, and a source terminal thereof is connected to the fourth pixel electrode PIX24.

As described above, according to this document, the polarity of the data voltages charged in the LC cells connected to the same data line is controlled to be the same, thereby it is possible to reduce power consumption in the source drive ICs and also make uniform an amount of data charged in each LC cell. Thus, according to this document, it is possible to prevent degradation in image quality such as brightness unevenness, color distortion, or the like resulting from the unevenness of the amount of data charged due to the inversion method in the related art, and to reduce power consumption in the source drive ICs by reducing the number of polarity inversion for the data voltages. In addition, according to this document, it is possible to reduce the number of the data lines and the channels of the source drive ICs by the use of the TFT connection relation where the LC cells adjacent to each other in the horizontal direction share one data line with each other.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a display panel provided with a plurality of data lines, a plurality of gate lines intersecting the data lines, liquid crystal cells arranged in a matrix, and TFTs disposed at the intersections of the data lines and the gate lines;

source drive ICs configured to supply data voltages to the data lines, wherein polarities of data voltages are reversed by a column inversion scheme; and a gate driver configured to sequentially supply gate pulses to the gate lines, wherein polarities of the data voltages charged in the liquid crystal cells in the display panel are reversed in dot unit, wherein at least a part of the display panel includes two liquid crystal cells disposed between data lines adjacent to each other in a (m+1)-th (where m is an odd number) horizontal display line so as to be spaced apart from two liquid crystal cells disposed between data lines adjacent to each other in an m-th horizontal display line, wherein the two liquid crystal cells in the m-th horizontal display line and the two liquid crystal cells in the (m+1)-th horizontal display line sequentially charge therein data voltages with the same polarity supplied from the same data line, and wherein a first data line is connected to a last data line by a connection line so that a same data voltage of a same polarity supplied from one of the source drive ICs is simultaneously supplied to the first data line and the last data line, the first data line being a data line disposed closest to the gate driver among the data lines, and the last data line being a data line disposed farthest from the gate driver among the data lines.

2. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth liquid crystal cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective even-numbered horizontal display lines, wherein the first and second liquid crystal cells in the odd-numbered horizontal display lines and the third and fourth liquid crystal cells in the even-numbered horizontal display lines charge therein data voltages with a first polarity which are sequentially supplied from the (i+1)-th data line, the first and second liquid crystal cells in the even-numbered horizontal display lines charge therein data voltages with a second polarity which are sequentially supplied from the i-th data line, and the third and fourth liquid crystal cells in the odd-numbered horizontal display lines charge therein the data voltages with the second polarity which are sequentially supplied from the (i+2)-th data line.

3. The liquid crystal display of claim 2, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the (i+1)-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+2)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the i-th data line to first pixel electrodes formed in the first liquid crystal cells in the even-numbered horizontal display lines, in response to the gate pulses from the (j+2)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+3)-th gate line;

third TFTs in the even-numbered horizontal display lines configured to transmit the data voltages from the (i+1)-th data line to third pixel electrodes formed in the third liquid crystal cells in the even-numbered horizontal display lines, in response to the gate pulses from the (j+2)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+3)-th gate line.

4. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth liquid crystal cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective odd-numbered horizontal display lines, wherein the first and second liquid crystal cells in the odd-numbered horizontal display lines charge therein data voltages with a first polarity which are sequentially supplied from the i-th data line, the third and fourth liquid crystal cells in the odd-numbered horizontal display lines and the first and second liquid crystal cells in the even-numbered horizontal display lines charge therein data voltages with a second polarity which are sequentially supplied from the (i+1)-th data line, and the third and fourth liquid crystal cells in the odd-numbered horizontal display lines charge therein the data voltages with the first polarity which are sequentially supplied from the (i+2)-th data line.

5. The liquid crystal display of claim 4, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the i-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+1)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+2)-th third gate line;

second TFTs in the even-numbered horizontal display lines configured to transmit the data voltages from the (i+1)-th data line to second pixel electrodes formed in the second liquid crystal cells in the even-numbered horizontal display lines, in response to gate pulses from the (j+3)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line; and fourth TFTs in the even-numbered horizontal display lines configured to transmit the data voltage from the (i+2)-th data line to fourth pixel electrodes formed in the fourth liquid crystal cells in the even-numbered horizontal display lines, in response to the gate pulses from the (j+3)-th gate line.

6. The liquid crystal display of claim 4, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the j-th gate line;

second TFTs in the odd-numbered horizontal display lines configured to transmit the data voltages from the i-th data line to second pixel electrodes formed in the second liquid crystal cell in the odd-numbered horizontal display lines, in response to the gate pulses from the (j+1)-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+1)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the (i+1)-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line; and fourth TFTs in the even-numbered horizontal display lines configured to transmit the data voltage from the (i+2)-th data line to fourth pixel electrodes formed in the fourth liquid crystal cells in the even-numbered horizontal display lines, in response to the gate pulses from the (j+3)-th gate line.

7. The liquid crystal display of claim 4, wherein at least a part of the liquid crystal cells further comprises fifth and sixth liquid crystal cells in the odd-numbered horizontal display lines, disposed between the (i+2)-th data line and a (i+3)-th data line in the respective odd-numbered horizontal display lines; and fifth and sixth liquid crystal cells in the even-numbered horizontal display lines, disposed between the (i+2)-th data line and the (i+3)-th data line in the respective even-numbered horizontal display lines, wherein the fifth and sixth liquid crystal cells in the odd-numbered horizontal display lines charge therein the data voltages with the first polarity which are sequentially supplied from the (i+2)-th data line, and the fifth and sixth liquid crystal cells in the even-numbered horizontal display lines charge therein the data voltages with the second polarity which are sequentially supplied from the (i+3)-th data line.

8. The liquid crystal display of claim 7, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the i-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+1)-th data line to fourth pixel electrodes formed in the fourth liquid crystal cells in the odd-numbered horizontal display lines, in response to the gate pulses from the j-th gate line;

fifth TFTs in the odd-numbered horizontal display lines configured to transmit the data voltages from the (i+2)-th data line to fifth pixel electrodes formed in the fifth liquid crystal cells in the odd-numbered horizontal display lines, in response to the gate pulses from the j-th gate line;

sixth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the (j+1)-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+2)-th third gate line;

second TFTs in the even-numbered horizontal display lines configured to transmit the data voltages from the (i+1)-th data line to second pixel electrodes formed in the second liquid crystal cells in the even-numbered horizontal display lines, in response to gate pulses from the (j+3)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line;

fourth TFTs in the even-numbered horizontal display lines configured to transmit the data voltage from the (i+2)-th data line to fourth pixel electrodes formed in the fourth liquid crystal cells in the even-numbered horizontal display lines, in response to the gate pulses from the (j+3)-th gate line;

fifth TFTs in the even-numbered horizontal display lines configured to transmit the data voltages from the (i+3)-th data line to fifth pixel electrodes formed in the fifth liquid crystal cells in the even-numbered horizontal display lines, in response to the gate pulses from the (j+3)-th gate line; and sixth TFTs in the even-numbered horizontal display lines configured to transmit the data voltage from the (i+3)-th data line to sixth pixel electrodes formed in the sixth liquid crystal cells in the even-numbered horizontal display lines, in response to the gate pulses from the (j+2)-th gate line.

9. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth liquid crystal cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective even-numbered horizontal display lines, wherein the first liquid crystal cells in the odd-numbered horizontal display lines charge therein data voltages with a first polarity which are supplied from the i-th data line, and the second liquid crystal cells in the odd-numbered horizontal display lines charge therein data voltages with a second polarity which are supplied from the (i+1)-th data line, the first liquid crystal cells in the even-numbered horizontal display lines charge therein the data voltages with the second polarity which are supplied from the (i+1)-th data line, and the second liquid crystal cells in the even-numbered horizontal display lines charge therein the data voltages with the first polarity which are supplied from the i-th data line, the third liquid crystal cells in the odd-numbered horizontal display lines charge therein the data voltages with the second polarity which are supplied from the (i+1)-th data line, and the fourth liquid crystal cells in the odd-numbered horizontal display lines charge therein the data voltages with the first polarity which are supplied from the (i+2)-th data line, and the third liquid crystal cells in the even-numbered horizontal display lines charge therein the data voltages with the first polarity which are supplied from the (i+2)-th data line, and the fourth liquid crystal cells in the even-numbered horizontal display lines charge therein the data voltages with the second polarity which are supplied from the (i+1)-th data line.

10. The liquid crystal display of claim 9, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+2)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+3)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+3)-th gate line.

11. The liquid crystal display of claim 9, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the j-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the (j+1)-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the j-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the (j+1)-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+3)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+2)-th gate line.

12. The liquid crystal display of claim 9, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the j-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the (j+1)-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+3)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+2)-th gate line.

13. The liquid crystal display of claim 9, wherein at least a part of the liquid crystal cells further comprises:

fifth and sixth liquid crystal cells in the odd-numbered horizontal display lines, disposed between the (i+2)-th data line and a (i+3)-th data line in the respective odd-numbered horizontal display lines; and fifth and sixth liquid crystal cells in the even-numbered horizontal display lines, disposed between the (i+2)-th data line and the (i+3)-th data line in the respective even-numbered horizontal display lines, wherein the fifth liquid crystal cells in the odd-numbered horizontal display lines charge therein the data voltages with the second polarity which are supplied from the (i+3)-th data line, and the sixth liquid crystal cells in the odd-numbered horizontal display lines charge therein the data voltages with the first polarity which are supplied from the (i+2)-th data line, and the fifth liquid crystal cells in the even-numbered horizontal display lines charge therein the data voltages with the first polarity which are supplied from the (i+2)-th data line, and the sixth liquid crystal cells in the even-numbered horizontal display lines charge therein the data voltages with the second polarity which are supplied from the (i+3)-th data line.

14. The liquid crystal display of claim 13, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the j-th gate line;

fifth TFTs in the odd-numbered horizontal display lines configured to transmit the data voltages from the (i+3)-th data line to fifth pixel electrodes formed in the fifth liquid crystal cells in the odd-numbered horizontal display lines, in response to the gate pulses from the j-th gate line;

sixth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the (j+1)-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+2)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+3)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line;

fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+3)-th gate line;

fifth TFTs in the even-numbered horizontal display lines configured to transmit the data voltages from the (i+2)-th data line to fifth pixel electrodes formed in the fifth liquid crystal cells in the even-numbered horizontal display lines, in response to the gate pulses from the (j+3)-th gate line; and sixth TFTs in the even-numbered horizontal display lines configured to transmit the data voltage from the (i+3)-th data line to sixth pixel electrodes formed in the sixth liquid crystal cells in the even-numbered horizontal display lines, in response to the gate pulses from the (j+2)-th gate line.

15. The liquid crystal display of claim 13, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the j-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the (j+1)-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the j-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the (j+1)-th gate line;

fifth TFTs in the odd-numbered horizontal display lines configured to transmit the data voltages from the (i+3)-th data line to fifth pixel electrodes formed in the fifth liquid crystal cells in the odd-numbered horizontal display lines, in response to the gate pulses from the (j+1)-th gate line;

sixth TFTs in the odd-numbered horizontal display lines configured to transmit the data voltages from the (i+2)-th data line to sixth pixel electrodes formed in the sixth liquid crystal cells in the odd-numbered horizontal display lines, in response to the gate pulses from the j-th gate line;

first TFTs in the even-numbered horizontal display lines configured to transmit the data voltages from the (i+1)-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the i-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+3)-th gate line;

fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+2)-th gate line;

fifth TFTs in the even-numbered horizontal display lines configured to transmit the data voltages from the (i+2)-th data line to fifth pixel electrodes formed in the fifth liquid crystal cells in the even-numbered horizontal display lines, in response to the gate pulses from the (j+2)-th gate line; and sixth TFTs in the even-numbered horizontal display lines configured to transmit the data voltage from the (i+3)-th data line to sixth pixel electrodes formed in the sixth liquid crystal cells in the even-numbered horizontal display lines, in response to the gate pulses from the (j+3)-th gate line.

16. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth LC cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective even-numbered horizontal display lines, wherein the first liquid crystal cells in the odd-numbered horizontal display lines charge therein data voltages with a first polarity which are supplied from the (i+1)-th data line, and the second liquid crystal cells in the odd-numbered horizontal display lines charge therein data voltages with a second polarity which are supplied from the i-th data line, the first liquid crystal cells in the even-numbered horizontal display lines charge therein the data voltages with the second polarity which are supplied from the i-th data line, and the second liquid crystal cells in the even-numbered horizontal display lines charge therein the data voltages with the first polarity which are supplied from the (i+1)-th data line, the third liquid crystal cells in the odd-numbered horizontal display lines charge therein the data voltages with the first polarity which are supplied from the (i+1)-th data line, and the fourth liquid crystal cells in the odd-numbered horizontal display lines charge therein the data voltages with the second polarity which are supplied from the (i+2)-th data line, and the third liquid crystal cells in the even-numbered horizontal display lines charge therein the data voltages with the second polarity which are supplied from the (i+2)-th data line, and the second liquid crystal cells in the even-numbered horizontal display lines charge therein the data voltages with the first polarity which are supplied from the (i+1)-th data line.

17. The liquid crystal display of claim 16, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the (i+1)-th data line to first pixel electrodes formed in the first liquid crystal cells in the odd-numbered horizontal display lines, in response to the gate pulses from the j-th gate line;

second TFTs in the odd-numbered horizontal display lines configured to transmit the data voltages from the i-th data line to second pixel electrodes formed in the second liquid crystal cell in the odd-numbered horizontal display lines, in response to the gate pulses from the (j+1)-th gate line;

third TFTs in the odd-numbered horizontal display lines configured to transmit the data voltages from the (i+1)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+2)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the i-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the (i+1)-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+2)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+3)-th gate line.

18. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth liquid crystal cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective even-numbered horizontal display lines, wherein the first liquid crystal cells in the odd-numbered horizontal display lines charge therein data voltages with a first polarity which are supplied from the i-th data line, and the second liquid crystal cells in the odd-numbered horizontal display lines charge therein data voltages with a second polarity which are supplied from the (i+1)-th data line, the first liquid crystal cells in the even-numbered horizontal display lines charge therein the data voltages with the first polarity which are supplied from the i-th data line, and the second liquid crystal cells in the even-numbered horizontal display lines charge therein the data voltages with the second polarity which are supplied from the (i+1)-th data line, the third liquid crystal cells in the odd-numbered horizontal display lines charge therein the data voltages with the first polarity which are supplied from the (i+2)-th data line, and the fourth liquid crystal cells in the odd-numbered horizontal display lines charge therein the data voltages with the second polarity which are supplied from the (i+1)-th data line, and the third liquid crystal cells in the even-numbered horizontal display lines charge therein the data voltages with the first polarity which are supplied from the (i+2)-th data line, and the fourth liquid crystal cells in the even-numbered horizontal display lines charge therein the data voltages with the second polarity which are supplied from the (i+1)-th data line.

19. The liquid crystal display of claim 18, wherein the gate driving circuit is configured to sequentially output the gate pulses to j-th (where j is a natural number) to (j+3)-th gate lines, and wherein the TFTs comprises:

first TFTs in the odd-numbered horizontal display lines configured to transmit the data voltages from the i-th data line to first pixel electrodes formed in the first liquid crystal cells in the odd-numbered horizontal display lines, in response to the gate pulses from the (j+1)-th gate line;

second TFTs in the odd-numbered horizontal display lines configured to transmit the data voltages from the (i+1)-th data line to second pixel electrodes formed in the second liquid crystal cell in the odd-numbered horizontal display lines, in response to the gate pulses from the j-th gate line;

third TFTs in the odd-numbered horizontal display lines configured to transmit the data voltages from the (i+2)-th data line to third pixel electrodes formed in the third liquid crystal cells in the odd-numbered horizontal display lines, in response to the gate pulses from the (j+1)-th gate line;

fourth TFTs in the odd-numbered horizontal display lines configured to transmit the data voltages from the (i+1)-th data line to fourth pixel electrodes formed in the fourth liquid crystal cells in the odd-numbered horizontal display lines, in response to the gate pulses from the j-th gate line;

first TFTs in the even-numbered horizontal display lines configured to transmit the data voltages from the i-th data line to first pixel electrodes formed in the first liquid crystal cells in the even-numbered horizontal display lines, in response to the gate pulses from the (j+3)-th third gate line;

second TFTs in the even-numbered horizontal display lines configured to transmit the data voltages from the (i+1)-th data line to second pixel electrodes formed in the second liquid crystal cells in the even-numbered horizontal display lines, in response to gate pulses from the (j+2)-th gate line;

third TFTs in the even-numbered horizontal display lines configured to transmit the data voltages from the (i+2)-th data line to third pixel electrodes formed in the third liquid crystal cells in the even-numbered horizontal display lines, in response to the gate pulses from the (j+3)-th gate line; and fourth TFTs in the even-numbered horizontal display lines configured to transmit the data voltage from the (i+1)-th data line to fourth pixel electrodes formed in the fourth liquid crystal cells in the even-numbered horizontal display lines, in response to the gate pulses from the (j+2)-th gate line.

20. The liquid crystal display of claim 1, wherein at least a part of the liquid crystal cells comprises:

first and second liquid crystal cells in odd-numbered horizontal display lines, disposed between an i-th (where i is a natural number) data line and a (i+1)-th data line in the respective odd-numbered horizontal display lines in the display panel;

third and fourth liquid crystal cells in the odd-numbered horizontal display lines, disposed in the (i+1)-th data line and a (i+2)-th data line in the respective odd-numbered horizontal display lines;

first and second liquid crystal cells in even-numbered horizontal display lines, disposed between the i-th data line and the (i+1)-th data line in the respective even-numbered horizontal display lines in the display panel; and third and fourth liquid crystal cells in the even-numbered horizontal display lines, disposed in the (i+1)-th data line and the (i+2)-th data line in the respective odd-numbered horizontal display lines.

* * * * *